US011684835B2

(12) United States Patent
DeRose

(10) Patent No.: US 11,684,835 B2
(45) Date of Patent: Jun. 27, 2023

(54) METHOD AND DEVICES FOR LIFTING-AND SETTING OF GOLF BALLS

(71) Applicant: Domenick Francis DeRose, Carmel, NY (US)

(72) Inventor: Domenick Francis DeRose, Carmel, NY (US)

( * ) Notice: Subject to any disclaimer, the term of this patent is extended or adjusted under 35 U.S.C. 154(b) by 0 days.

(21) Appl. No.: 16/677,987

(22) Filed: Nov. 8, 2019

(65) Prior Publication Data

US 2021/0138324 A1 May 13, 2021

(51) Int. Cl.
*A63B 57/00* (2015.01)
*A63B 57/20* (2015.01)

(52) U.S. Cl.
CPC ..... *A63B 57/0037* (2013.01); *A63B 57/203* (2015.10)

(58) Field of Classification Search
CPC ... A63B 57/0037; A63B 57/203; A63B 47/02; A63B 55/50; A63B 69/3661; A63B 69/3623; A63B 69/3641; A47G 25/12; F16M 13/08; A61H 3/066
See application file for complete search history.

(56) References Cited

U.S. PATENT DOCUMENTS 2,609,198 A 9/1952 Armstrong
3,889,946 A 6/1975 Setecka
4,095,788 A * 6/1978 Benenson ..... A63B 57/357 473/176
4,179,417 A * 12/1979 Sunada ..... C09D 125/14 525/444.5
4,313,604 A * 2/1982 Baxter ..... A63B 57/0037 294/19.2
4,507,881 A * 4/1985 Fossa ..... A43B 5/18 273/DIG. 18
4,589,661 A * 5/1986 Attig ..... A63B 57/0037 473/133
4,951,947 A * 8/1990 Kopfle ..... A63B 47/02 294/19.2
4,969,646 A 11/1990 Tobias
5,102,139 A * 4/1992 Greig ..... A63B 57/207 473/286
5,163,677 A 11/1992 Foley
5,306,000 A * 4/1994 Comella ..... A63B 57/10 473/133
5,310,177 A 5/1994 Conrad
5,330,178 A 7/1994 Geishert
5,351,964 A 10/1994 Kruger
(Continued)

FOREIGN PATENT DOCUMENTS

CA 2449228 A1 * 12/2002 ..... A63B 69/3694
CA 2507408 A1 * 11/2006 ..... A63B 47/02
(Continued)

*Primary Examiner* — Steven B Wong
(74) *Attorney, Agent, or Firm* — Graham S. Jones, II

(57) ABSTRACT

A method and apparatus for lifting and setting a golf ball on a golf tee without bending include a shaft holding a lifter-setter tool to lift and set a golf ball onto a golf tee plus a parking tray with means for parking a lifter-setter tool upright on the parking tray. The lifter-setter tool is parked upright on the parking tray with Readily Dissociable Fasteners (RDFs) including an upright parking pin fastened to the parking tray and hook-and-loop fasteners, touch fasteners, and mushroom head fasteners, inter alia.

9 Claims, 16 Drawing Sheets

(56) References Cited

U.S. PATENT DOCUMENTS 5,407,194 A * 4/1995 Snow ..... A63B 47/02 294/19.2
5,494,279 A * 2/1996 Ahner ..... A63B 57/0037 473/386
5,499,813 A * 3/1996 Black ..... A63B 57/0037 473/386
5,513,841 A 5/1996 Tukagi
5,540,432 A * 7/1996 Keller ..... A63B 57/0037 473/386
5,624,333 A * 4/1997 Dayton ..... A63B 57/0037 473/386
5,639,055 A * 6/1997 Fritz ..... A61H 3/0244 248/519
5,651,742 A * 7/1997 Dickson ..... A63B 47/02 473/217
5,690,558 A * 11/1997 Huber ..... A63B 47/02 294/19.2
5,743,819 A 4/1998 Chum
5,759,117 A 6/1998 Erickson
5,931,317 A 8/1999 Zusack
6,159,108 A * 12/2000 de la Pena ..... A63B 47/02 473/286
6,569,028 B1 5/2003 Nichols
6,692,374 B1 * 2/2004 Colbo ..... A63B 47/02 294/19.2
6,843,737 B1 * 1/2005 Smith ..... A63B 57/0037 473/386
6,852,040 B1 * 2/2005 Williams ..... A63B 47/02 473/286
6,926,622 B1 * 8/2005 Yates ..... A63B 47/02 294/19.2
6,997,816 B2 2/2006 Gager
D517,139 S * 3/2006 Kim ..... D21/721
7,059,969 B2 6/2006 Howe
7,549,937 B2 6/2009 Irwin
8,852,018 B1 * 10/2014 Hanley ..... A63B 47/02 473/286
9,011,263 B2 4/2015 Brown
D882,709 S * 4/2020 Mickley ..... D21/789
2003/0092498 A1 * 5/2003 Jaramillo, Jr. ..... A63B 57/0006 473/285
2003/0173486 A1 * 9/2003 Cirrincione ..... A47G 25/12 248/351
2004/0067798 A1 * 4/2004 O'Donnell ..... A63B 57/0006 473/286
2005/0170904 A1 * 8/2005 Smeeth ..... A63B 47/02 473/286
2007/0293353 A1 * 12/2007 Irwin ..... A63B 57/0037 473/386
2007/0293354 A1 * 12/2007 Irwin ..... A63B 57/00 473/386
2008/0005947 A1 * 1/2008 Barna ..... G09F 19/22 40/629
2009/0108167 A1 * 4/2009 White ..... A47G 25/12 248/519
2010/0087265 A1 * 4/2010 Rolando ..... A63B 57/00 473/132
2010/0163086 A1 * 7/2010 Chavez ..... A45B 3/00 135/16
2013/0032185 A1 * 2/2013 Sato ..... A45B 9/04 135/68
2017/0332748 A1 * 11/2017 Kaplan ..... A45B 3/00

FOREIGN PATENT DOCUMENTS

CH 671704 A5 * 9/1989 ..... A63B 57/0037
DE 102008016219 A1 * 10/2009 ..... A61H 3/0244
DE 102010024979 A1 * 12/2011 ..... A61H 3/04
NL 9101554 A * 4/1993 ..... A63B 57/0037

* cited by examiner

METHOD AND DEVICES FOR LIFTING-AND SETTING OF GOLF BALLS

This application claims the benefit of U.S. Provisional Application No. 62/844,272, filed May 7, 2019 entitled "Allows the User to Tee Up Golf Balls Without Having to Bend Down in Order to Do So", and U.S. Provisional Application No. 62/847,738 filed May 14, 2019 entitled "The Gadget Enables Driving Range Patrons to Pick Up Golf Balls and Tee Up Without Having to Bend Over" are incorporated herein by reference in their entireties.

TECHNICAL FIELD

This invention relates to a method and tools for lifting a golf ball and setting a golf ball on a golf tee at a golf driving range ready to be driven with a golf club.

More particularly this invention relates to a method of using a golf ball lifter-setter tool on the lower end of a manual shaft for lifting a golf ball, setting the golf ball on a golf tee, and then moving the tool away from the golf tee, yet leaving the golf ball on the golf tee ready to be driven with a golf club.

BACKGROUND OF THE INVENTION

Technical Problem

Heretofore, in learning and practicing of skills in driving golf balls from golf tees at golf driving ranges, a serious problem has been that golfers have been required to bend down to grasp a golf ball and then to reach down to place it on a golf tee which strains the body of the golfer. This problem also exists on drives of golf balls from the tees towards a fairway as a player goes from tee to tee on a golf course.

The following patents focus on solutions of problems that exist on a golf course as contrasted with a golf driving range.

U.S. Pat. No. 2,609,198 V. C. Armstrong for "Device For Setting Golf Balls and Tees" describes "a device which will enable a golfer, by a single operation, properly to place a ball on a tee, ready for driving, without bending or stooping, thereby making it possible to accomplish this objective with the golfer standing in a substantially erect or fully erect position . . . a device which may be conveniently carried as a part of golfing equipment in a golfbag, along with clubs, so that it may be readily transported during the course of the game, and yet always be ready for use when the occasion demands that a ball be teed up before it is hit enabling the ball and tee to be properly set for driving by a single manipulation of the device."

U.S. Pat. No. 7,549,937B2 of Irwin for Golf Ball & Tee Setter Apparatus stated in the abstract as follows: "A golf ball and tee setting apparatus allows a golf tee to be set in the ground and a golf ball placed thereon without the golfer having to bend over. An elongated shaft has two end portions and a ball supporting member on one end portion of the shaft and a bore on the other end of the elongated shaft. A golf tee is releasably held in the shaft bore for insertion into the earth. The shaft can then be rotated to a golf ball supporting end and a golf ball placed on the tee."

The Irwin patent stated about the prior art as follows: "an apparatus in which an elderly or handicapped golfer with back problems can place a tee into the ground and set a golf ball on top of the tee from a standing position. A number of different types of golf ball and tee placing devices have been provided in the past. The prior art Smith et al. U.S. Pat. No. 6,843,737 shows a golf ball and tee setting device and method which facilitates the setting of a tee into the ground with a ball on top of it without causing the user to bend over at the waist. The Armstrong U.S. Pat. No. 2,609,198 and the Kopfle U.S. Pat. No. 4,951,947 disclose golf ball and tee combinations in which the ball holding mechanism is biased in an upward and open position. They require the user to forcibly hold a trigger or knob to retain the ball and tee combination during a golf ball and tee setting. The Setecka, U.S. Pat. No. 3,889,946, shows a portable adjustable tee and ball positioning device for pressing golf ball tees into the ground at desired positions and to the desired depth and height without the user bending over to manually mount the tee into the ground. The Erickson, Jr. U.S. Pat. No. 5,759,117 teaches another golf ball and tee placing device in which the golfer may handle a golf ball without having to bend over. The Keller U.S. Pat. No. 5,540,432 is a golf tee and ball setter for non-stooping placement of golf balls and golf tees on site. The Ahner U.S. Pat. No. 5,494,279 is another golf ball tee setting device for setting a golf tee into the ground. The Tobias U.S. Pat. No. 4,969,646 is yet another golf ball tee and placement device as is the Geishert, Sr. U.S. Pat. No. 5,330,178."

U.S. Pat. No. 5,310,177 of Conrad et al. for "No-Bend Golf Device" describes "An apparatus for placement of golf balls and golf tees comprising an elongated shaft with a forked ball and tee holding device on the lower end of the shaft. The upper end of the shaft is comprised of a sliding pull hooked handle. It is operated by pulling the tee and ball inwards to the shaft with the hooked handle to form a compression. This holds the ball and tee together so it can be pushed into the ground. The weight of the forked foot drops the compression when the hooked handle is released, releasing the foot from the teed ball."

U.S. Pat. No. 6,817,955 of O'Donnell & Egli stated "Many people who otherwise desire to play the game of golf, either limit their amount of play or resist playing because of such stooping and bending. This can be especially true for aging persons who have difficulty bending or stooping. This also includes persons of any age who have medical conditions that make it difficult to bend or stoop. One example is hip or knee replacements." The O'Donnell abstract states as follows: "A golfing tool or accessory to reduce or eliminate substantial stooping and bending of a golfer includes a mounting member for snap-fitting the tool or accessory to a golf club shaft or grip and first member for cradling a golf ball. Another aspect of the invention includes a tee holder for holding the tee to allow it to be inserted into the ground by manipulating the golf club shaft without stooping or bending. Further aspects of the invention can include . . . a scissors-action of jaws of the tool for popping a golf ball into position on the tool."

O'Donnell & Egli teaches using a lifter-setter (golf accessory) for placing a golf ball on a golf tee and removing the lifter-setter reads as follows: "A golf accessory for handling golf balls and tees without substantial bending or stooping comprising: (a) a first member adapted to releasably snap-fit to the grip end of a golf club to hold the accessory against movement relative to the golf club; (b) a second member connected to the first member and having an extension adapted to cradle a golf ball, so that when a golf club is installed in the first member a user can move the ball to the desired position, including on a tee, and remove the accessory from the ball without bending or stooping, wherein the second member comprises an opening with a diameter less than the greatest outside diameter of a conventional golf ball and the extension comprises a jaw which is resiliently deflectable." However, there is no suggestion of what to do with the accessory after placing the golf ball on the golf tee.

The following patents relate to problems that exist at a golf driving range on as contrasted with a golf course.

In the past prior to automation of setting balls on golf tees, learning and practicing of skills in driving golf balls from golf tees at golf driving ranges, a serious problem had been that golfers had been required to bend down to grasp a golf ball and then to reach down to place it on a golf tee. That problem still exists at some driving ranges. Moreover the cost of installing and maintaining automated devices is significant.

U.S. Pat. No. 9,011,263B2 of Brown for Automatic Setter states as follows: "It can be appreciated that automatic golf tees have been in use for years. Typically, automatic golf tees include a golf ball reservoir, that houses all the balls for the unit. It helps guide the golf balls to the tee after the ball leaves the ball reservoir. It typically can be adjusted for proper releasing of the ball in case of unlevel surfaces. Some devices physically place a single golf ball on a stationary tee from a plurality of golf balls using an external power source to drive a motor and/or solenoids to achieve the desired effect. Other devices utilize photoelectric cells to monitor and control numerous switches to operate a mechanical apparatus to place the ball on the tee.

U.S. Pat. No. 5,282,629 to Randall S. Eckstein is an example of an apparatus that incorporates air cylinders to sort out a single ball, physically lift it to the practice surface and place it on the tee. Some designs require digging large holes, pouring concrete, and embedding components in the ground in order to operate.

U.S. Pat. No. 5,016,886 by Bobby J. Gould is an example of a golf tee device that requires a vacuum of air to drive various components. Most devices require movements by the golfer to control mechanical apparatuses to place the ball on the tee."

U.S. Pat. No. 9,011,263B2 of Brown states further as follows: "The main problem associated with prior art conventional automatic golf tee devices are that although most of the devices serve their purpose placing a golf ball on a stationary tee, the various designs use very sophisticated mechanical apparatuses and many use intricately machined and specialized parts to complete this task making the process of teeing up the ball much more complicated than necessary. Frequent maintenance is needed such as lubrication of the various parts and components. Otherwise, malfunctioning and jamming of the golf ball can occur, which takes away from the concentration and pleasure of the golfing experience of the user. Another problem with conventional prior art automatic golf tee devices, is that the weight of the devices is large, so that the devices are very heavy and cumbersome. Some of these prior art devices weigh in excess of several hundred pounds making easy portability nearly impossible without assistance from others or without use of loading equipment. The operator of the prior art automatic golf tee device must travel to a location where the device is already housed before the individual can use the device. This limits where the individual can use the device. This lack of accessibility greatly reduces the devices practical use for an ordinary individual who wishes to use the device in a short time without traveling. Users who are willing to spend a great deal of money can install one of these devices in their home, but cost can be a severely limiting factor for many people. Another problem with conventional prior art automatic golf tee devices is that many require a power source that must be applied to the device to provide the operation of sorting a single ball from a plurality of balls, and setting it on the stationary tee. Prior art designs include using onboard batteries with charging systems and/or requiring constant connection to standard 110 V wall sockets. These requirements severely limit the transportability of the device as they prohibit use of the device in locations where a power source is not available. Also, using the device with the power connected can potentially be a serious hazard to the operator if used in wet or rainy conditions."

Brown then states as follows: "Therefore, a need exists in the art for a golf tee device that overcomes problems associated with prior art golf tee devices. These problems are overcome by the portable mechanical golf tee device of the present invention that substantially departs from the conventional concepts and designs of the prior art, and provides an apparatus that allows a person to easily place a golf ball on a golf tee repeatedly by means of a simple human-powered device. The portable mechanical golf tee device of the present invention is easily transportable and simple to use, resulting in a device that is more enjoyable to utilize by the end user without need for the user to change their natural hitting stance while maintaining concentration on hitting the ball. The portable mechanical golf tee device of the present invention minimizes potential physical problems associated with users of prior art devices that require the user to bend over to tee the ball each time a ball is hit by the user. The portable mechanical tee device of the present invention eliminates the need for a power source, thereby making the invention "eco" and "green" friendly. This provides safety for the user by eliminating any shock hazard associated with utilizing the device in wet or damp conditions. The portable mechanical tee device of the present invention can be utilized either indoors or outdoors, or at any location where there is sufficient space to set up the device. Moreover, because the device is simple and lightweight, it can be easily moved by the golfer from one location to another without the need for assistance or additional lifting devices or aids."

However, the Brown portable mechanical golf tee machine, while simpler than conventional automatic golf tee devices, is a relatively complicated machine.

Technical Problem

When a golfer is practicing skills for driving golf balls at golf driving ranges, large numbers of golf balls are driven from a golf tee. In the absence of automated tee setting machines, driving of each golf ball with a golf club, the golfer must bend down to grasp the golf ball manually and then reach over to place the golf ball on a golf tee. The step of placing the golf ball on the golf tee is referred to hereinafter as teeing up. After teeing up the golf ball, the ball is driven with a golf club. Golf balls are driven, one by one, from the golf tee during a practice session. A serious problem for many golfers is that the repeated, manual teeing up (placing a ball) on a tee requires the golfer to bend down to pick up the golf ball and then to reach over to place it on the golf tee. The bending down during the manual teeing up process is often a painful and hazardous, especially for those with disabilities such as back, hip, or leg injuries. Moreover, the manual teeing up process fatigues any golfer during a practice session. In general, at golf driving ranges a golfer starts with a large bucket of balls which need to be manually put onto a golf tee (teed up) repeatedly. Repetition of that process is fatiguing, backbreaking, and can cause injuries to the back hip, or legs and can exacerbate preexisting injuries An object of this invention is to facilitate the process of a golfer teeing up a golf ball at a golf driving range.

Another object of the present invention is to provide a method and apparatus that enables patrons at golf driving ranges to perform the twin functions of employing a lifter-setter tool for picking up a golf ball from a tray, a bucket, or a surface followed by placing that golf ball on a golf tee with lifter-setter tool, removing the lifter-setter tool from below the golf ball on the tee, and conveniently parking the lifter-setter tool nearby for use thereby eliminating the need for the golfer to bend over when performing either function.

An object of this invention is to reduce the time required to set balls on a golf tee at a golf driving range without requiring automatic or portable machines as golf tee setters.

Another object of the present invention is to provide a method and apparatus that enables patrons at golf driving ranges to perform the twin functions of employing a lifter-setter tool for picking up a golf ball from a tray, a bucket, or a surface followed by placing that golf ball on a golf tee with lifter-setter tool and removing the lifter-setter tool from below the golf ball on the tee thereby eliminating the need for the golfer to bend over when performing either function.

The present invention comprises a method for facilitating picking up a golf ball and placing the golf ball on a golf tee at a golf driving range.

More particularly the invention relates to a method and tools for lifting a golf ball from a surface and setting the golf ball on a golf tee with a lifter-setter tool so the golf ball is ready to be driven with a golf club.

The present invention comprises a simple easily performed method for picking up a golf ball and placing the golf ball on a golf tee at a golf driving range with a lifter-setter tool.

More particularly the invention relates to a method and tools for lifting a golf ball from a surface with a lifter-setter tool and setting the golf ball on a golf tee ready to be driven with a golf club, and then removing lifter-setter tool and parking it aside from the golf tee.

A variety of lifter-setter tools in accordance with this invention can be used for performing the method of this invention are referred to hereinafter as claw, push down, and shovel-up types of tools. Such lifter-setter type tools solve the problem of having to bend down to grasp a golf ball and then to place the ball on a golf tee (i.e. tee up). In particular, the method of this invention employs lifter-setter tools that facilitate picking up and teeing up a golf ball on a golf tee in places such as golf driving ranges.

Solution to Problem

The problem of manually teeing up (placing a ball) golf ball driving range is provide a simplified method of placing a golf ball on a golf tee at a golf driving range for lifting a golf ball from a surface, placing the golf ball on a golf tee and then removing the lifter-setter tool from beneath the golf ball, and reparking the golf ball lifter-setter tool thereby leaving the golf ball on the tee ready to be hit by a golf club.

SUMMARY OF INVENTION

The present invention comprises a method employing parking a golf ball lifter-setter tool on a golf driving range, using lifter-setter tool both to lift a golf ball from a surface, and to place the golf ball on a golf tee, and then lowering the lifter-setter tool below the golf ball and removing the lifter-setter tool from the golf tee. The lifter-setter tools that can be used include claw, push down, and shovel-up types of lifter-setter tools. Those tools and their use solve the problem of having to bend down to place (i.e. tee up) a golf ball on a golf ball support such as a golf tee. In particular, the method of this invention employs golf ball lifter-setter tools that facilitate picking up and teeing up a golf ball on a tee in places such as golf driving ranges. The golfer does not need to bend down and perform teeing up while standing erect.

In accordance with one aspect of this invention, a method of lifting and setting a golf ball on a golf tee comprises a) provide a park and release system with a shaft holding a lifter-setter tool to lift and set a golf ball onto a golf tee plus a parking tray with means for parking a lifter-setter tool upright on the parking tray wherein the park and release system means for parking a lifter-setter tool upright on the parking tray is selected from Readily Dissociable Fasteners (RDFs) selected from the group consisting of parking a lifter-setter tool on an upright parking pin fastened to the parking tray and hook-and-loop fasteners, touch fasteners, and mushroom head fasteners, inter alia; and b) provide golf balls near a golf tee including a golf ball to be grasped with a lifter-setter tool; and then a user, player or golfer performs the steps as follows: c) moves the shaft to position the lifter-setter tool proximate to one of the golf balls; d) then grasps the golf ball with the lifter-setter tool; e) sets the golf ball on a golf tee of a golf course or a golf driving range with the lifter-setter tool; and f) then lowers the lifter-setter tool below the golf ball on the golf tee set on the golf tee; g) then moves the lifter-setter tool laterally leaving the golf ball on the golf tee; and then h) parks the lifter-setter tool upright on the parking tray using a park In accordance with one aspect of this invention for manual lifting and setting a golf ball on a golf tee comprising a park and release system including a shaft holding a lifter-setter tool to lift and set a golf ball onto a golf tee; a parking tray with means for parking a lifter-setter tool upright on the parking tray wherein the park and release system means for parking a lifter-setter tool upright on the parking tray is selected from Readily Dissociable Fasteners (RDFs) selected from the group consisting of means for parking a lifter-setter tool on an upright parking pin fastened to the parking tray and hook-and-loop fasteners, touch fasteners, and mushroom head fasteners and the like.

In accordance with one aspect of this invention, the upright parking pin is tilted for convenience of a user and the push down, parkable, lifter-setter tool includes two flexible legs on opposite sides of the shaft with two feet and toes also on opposite sides of the shaft forming a nest for a golf ball; the parking tray is attached to a golf tee support; the parking tray is attached to a golf tee support; the parking pin includes a polymer coated, metal core, a threaded bore for securing the parking pin to a plate fastened to the bottom surface of the golf ball tray by a cap screw and on both surfaces of the plate.

Preferably, the push down, parkable, lifter-setter tool includes two flexible legs with two feet and toes legs on opposite sides of the shaft forming a nest for a golf ball, the push down, parkable, lifter-setter tool includes two flexible legs on opposite sides of the shaft with two feet and toes also on opposite sides of the shaft form a nest for a golf ball; the parking pin includes a polymer coated, metal core, a threaded bore for securing the parking pin to a plate fastened to the bottom surface of the golf ball tray by a cap screw and on both surfaces of the plate. Preferably in step (a) the lifter-setter tool is provided with a parking pin hole therein for mating with the upright parking pin fastened to the parking tray; and in step (h) the golfer parks the lifter-setter tool upright on the parking pin on the parking tray by mating the lifter-setter tool with the parking pin.

DETAILED DESCRIPTION OF THE INVENTION

Figure 1:
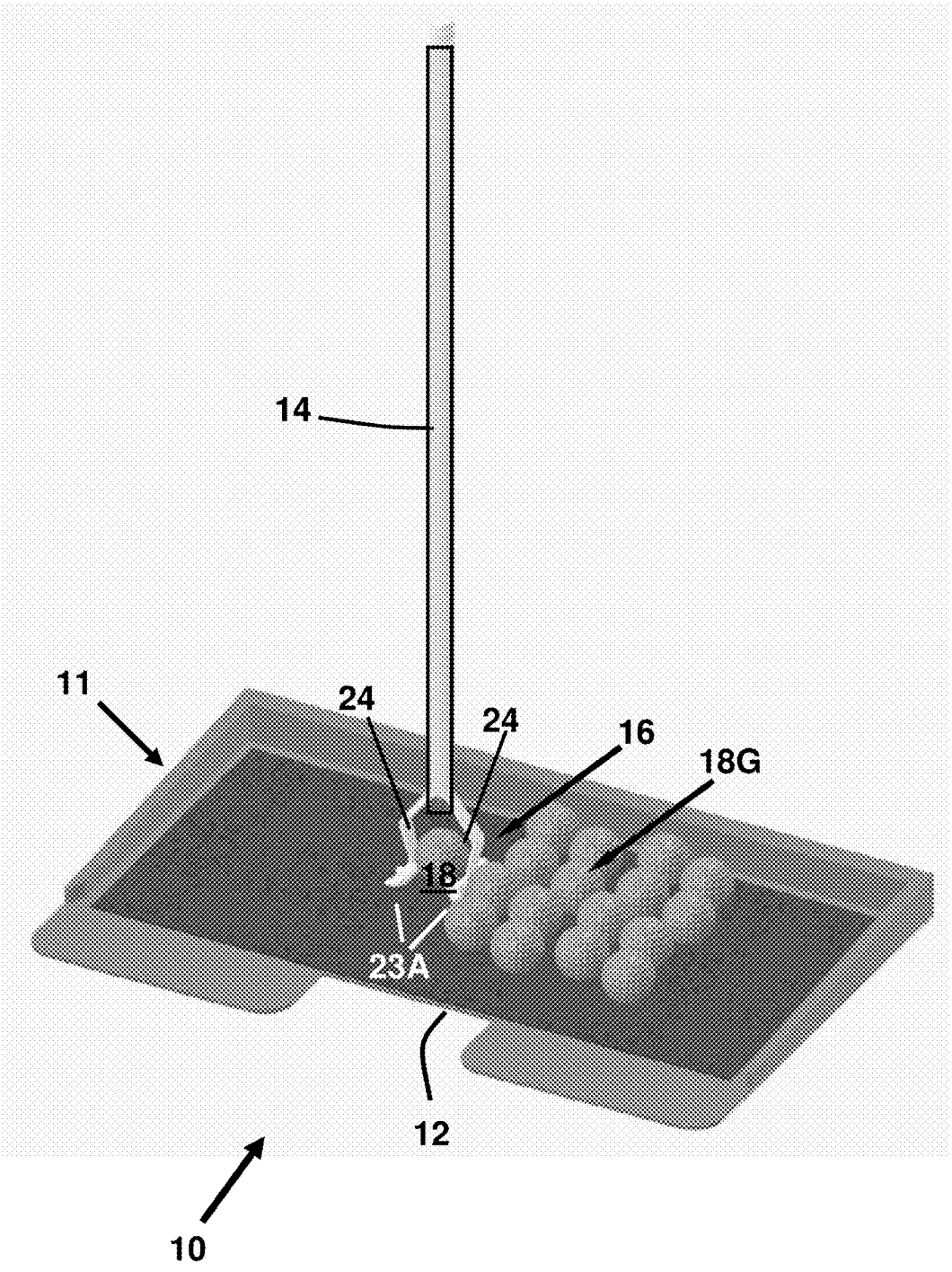
FIG. 1 shows driving range apparatus including a golf ball lifter-setter useful for lifting a golf ball from a golf driving range tray containing golf balls and for setting a golf ball on a golf tee.

FIG. 1 shows driving range apparatus 10 including a push down, lifter-setter 16A attached to the bottom of a shaft 14 provided for manually using the lifter-setter 16 to grasp a golf ball 18 and set it on a golf tee.

The lifter-setter 16 shown in FIG. 1 is an example of a variety of kinds of golf ball lifter-setters, which are adapted for grasping a golf ball 18 on a golf ball tray 11, filled with a plurality of golf balls 18G. A push down ball lifter-setter tool is defined herein as a tool which includes a head with two flexible legs on opposite sides of a shaft serving as a handle. Feet and toes are attached to each leg forming a nest for a golf ball. Furthermore, as defined here, the push down ball lifter-setter tool can grasp, lift and set a golf ball onto a golf tee, with the two flexible legs being adapted to widen by bending as the feet and toes press against the sides of the ball until the ball falls into the nest. Then when the push down ball lifter-setter tool places a golf ball on a golf tee, the tool is lowered and withdrawn from the golf tee leaving the golf ball on the golf tee. A push down ball lifter-setter tool attached to the shaft can be employed in a park and release system in which the push down ball lifter-setter tool can be parked near the golf tee. One parking method is to use Readily Dissociable Fasteners (RDFs) Alternatively, one can employ a parking pin hole in the bottom of the head of the push down ball lifter-setter tool parking with the pin hole to mate with an upright parking pin on a support. In FIG. 1 the full length push down, ball lifter-setter tool 16 is shown after it has been lowered down onto the center of a golf ball 18 with the truncated shaft 14 i.e., a handle attached to the head 16H of the lifter setter 16 tool, as shown in FIG. 2B, of the push down, ball lifter-setter tool 16 to grasp the golf ball 18. Then a user, i.e. golfer, can lift the full length shaft 14 shown in FIGS. 1 and 2B to move the lifter-setter 16 holding the golf ball 18 from the tray 11. The push down, lifter-setter tool 16, attached to the bottom of the shaft 14, has a nest 16N shown in FIG. 2A for a golf ball 18, comprising two flexible legs 24 with feet 23A therebelow. The two flexible legs 24 and the two feet 23A form the nest 16N (i.e. a cradle) for supporting the golf ball 18 after a golfer has captured it with the lifter-setter 16. The flexible legs 24 of the push down, ball lifter-setter tool 16 are shown in contact with opposite sides of the golf ball 18 holding it in place. The two feet 23A support the bottom of the golf ball 18. To repeat, as shown in FIG. 1 the push down, ball lifter-setter tool 16A has been lowered down towards the center of a golf ball 18 with the shaft 14 for the lifter-setter tool 16 to grasp the golf ball 18. Then a golfer can lift the shaft 14 as shown in FIGS. 3E and 3F to move the golf ball 18 from the tray 11A. The tool comprising a push down, ball lifter-setter tool 16 at the bottom of a shaft 14, handle, is adapted to grasp a golf ball 18 for lifting the golf ball 18 from the tray 11 shown in FIGS. 1, 2A and 2B. Then the push down, ball lifter-setter 16 can set that golf ball 18 on a golf tee provided by a driving range or a golf tee 20 such as that shown of a stand alone embodiment of the invention which is described with reference to in FIGS. 4A-4E.

FIGS. 2A-2F show details of the driving range apparatus of FIG. 1.

Figure 2A:
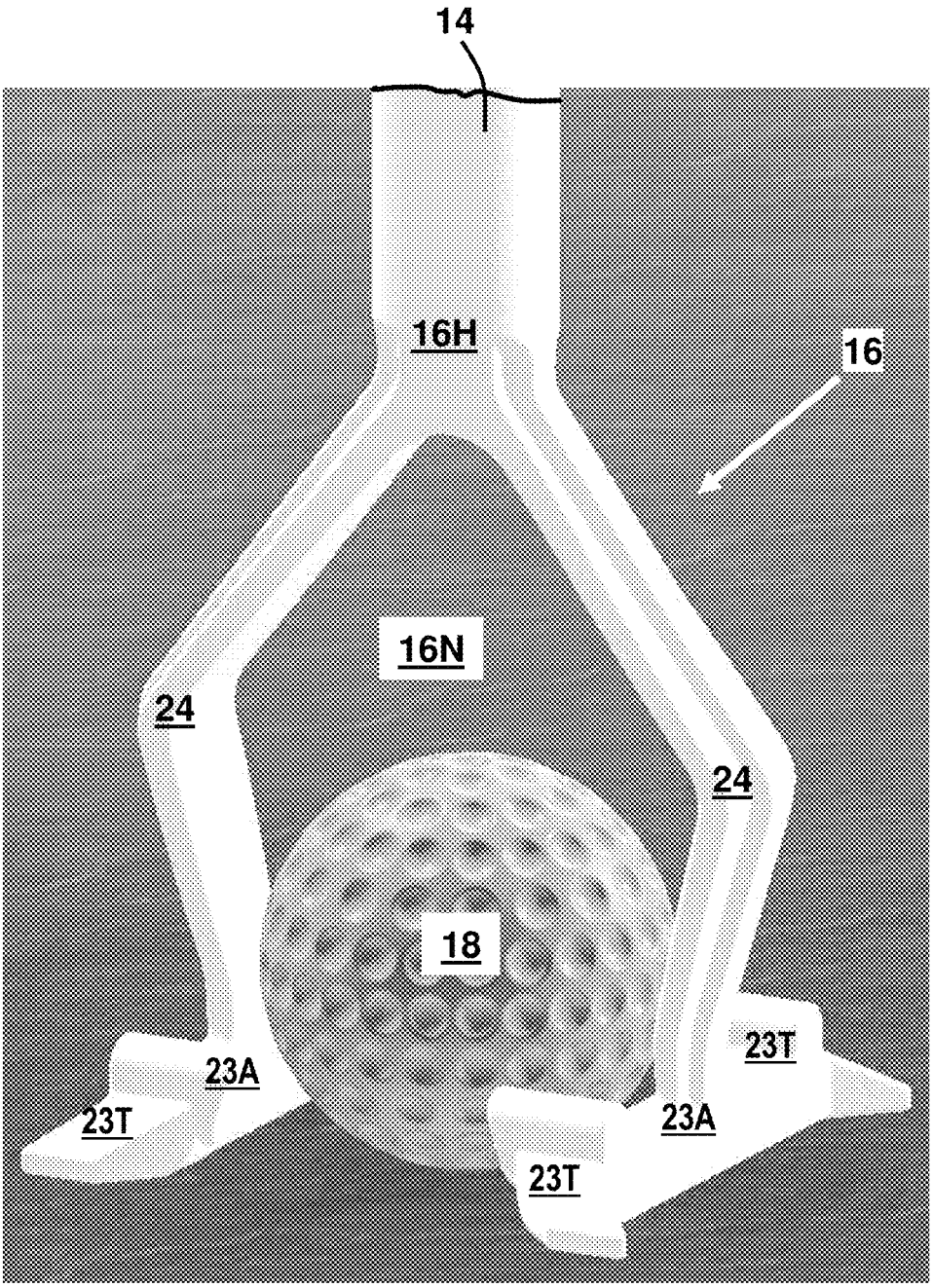
FIGS. 2A-2F show details of the driving range apparatus of FIG. 1.
Figure 2B:
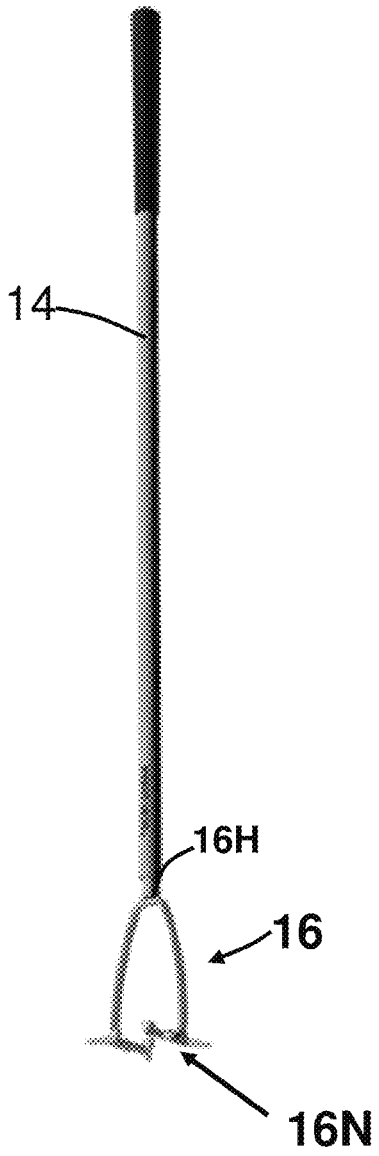

FIG. 2A is a perspective view of the push down, ball lifter-setter tool 16 of FIG. 1 with the truncated shaft 14 attached to the head 16H of the push down ball lifter-setter tool 16 having a pair of lateral, flexible legs 24 (composed of flexible material) therebelow and integral therewith. The push down ball lifter-setter tool 16 has a golf ball 18 held in a cradle type of nest 16N between the lateral, flexible legs 24 and resting on the feet 23A and toes 23T attached to the bottoms of each of the flexible legs 24 form the nest 16N of the push down, lifter-setter tool 16. Using the push down, ball lifter-setter tool 16, a player can grasp a golf ball 18, with the lifter-setter tool 16 with its jaw-like elements by positioning it above, i.e. straddling, the top of a golf ball 18. Then the user, i.e player, without bending over presses the push down, ball lifter-setter tool 16 down with the shaft 14 of FIG. 2A that is shown truncated for convenience of illustration. That pressure, passed down through the head 16H of the push down ball lifter-setter tool 16, to the legs 24 and the feet 23A and toes 23T, causes the lateral feet 23A to separate and for the lateral flexible legs 24 on either side of the lifter-setter tool 16A to widen by bending, thereby creating tension against the rounded sides of a golf ball 18. Because of the resistance of the hard rounded sides of the golf ball 18, and the flexible material of the lateral flexible legs 24 of the push down, ball lifter-setter tool 16 and the downward manual pressure of the user, i.e. golfer, on a full length shaft 14 with the pressure passed down through the head 16H as the golf ball 18 rises to a certain point there is a release of the tension causing the golf ball 18 to spring upward. Then the golf ball 18 which has been grasped settles down into the nest 16N. The golf ball 18 rests between the flexible legs 24 on the two lateral feet 23B and toes 23T and as a result is positioned to be lifted and moved into position to be set down to rest on a golf tee 20. When the golf ball 18 is lowered with the shaft 14 onto the golf tee 20, the golf ball 18 is ready to be released from the grasp of the push down ball lifter-setter tool 16. At that point the golfer can lower the push down ball lifter-setter tool 16 below the bottom surfaces of the golf ball 18, thereby releasing the grip of the push down, ball lifter-setter tool 16 thereon. Because the open ends of the lateral feet 23B and toes 23T thereof are then below the golf ball 18, the lowered push down, ball lifter-setter tool 16A can be slid laterally away from the golf tee 20 and parked elsewhere, leaving the golf ball 18 ready for the user, i.e. player, to hit it with a golf club.

FIG. 2B is a perspective view of the push down, lifter-setter 16 of FIG. mounted on a full length shaft 14 with a nest 16N, and a head 16H.

Figure 2C:
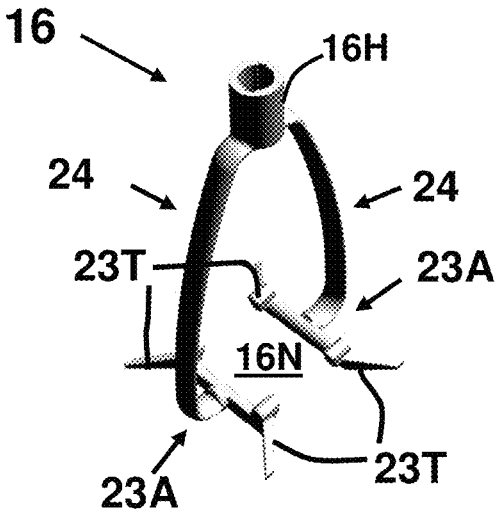

FIG. 2C is an enlarged, perspective view of a push down, lifter-setter 16 with a golf ball nest 16N, a head 16H, a pair of legs 24, lateral feet 23A and toes 23T.

Figure 2D:
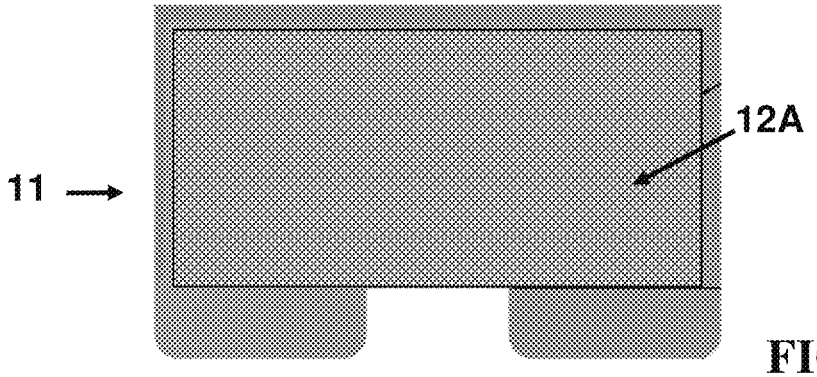

FIG. 2D is a plan view of an empty golf ball tray 11 for a golf driving range having a surface comprising hook-and-loop fasteners 12A which can fasten and release an attached object, i.e. a type of readily dissociable fastener. Referring to both FIG. 1 and FIG. 2D the fasteners 12A of FIG. 2D are provided for temporarily parking the lifter-setter 16 and its shaft 14 on the tray 11 in an upright position for access to the golfer. The types of fasteners 12A which can be employed as Readily Dissociable Fasteners (RDFs) referred to hereinafter as RDFs include hook-and-loop fasteners shown by (U.S. Pat. No. 2,717,437), touch fasteners (U.S. Pat. Nos. 5,932,311; 9,210,970), and mushroom head fasteners (U.S. Pat. No. 5,077,870), and fasteners comprising alternative fasten and release varieties. FIG. 2D is a plan view of an empty golf ball tray 11 for a golf driving range having a surface of surface comprising hook-and-loop fasteners.

Figure 2E:
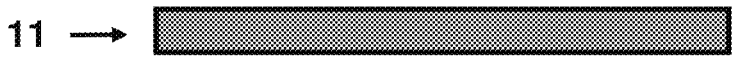

FIG. 2E is a front elevation of the empty golf ball tray 11 of FIG. 2D.

Figure 2F:
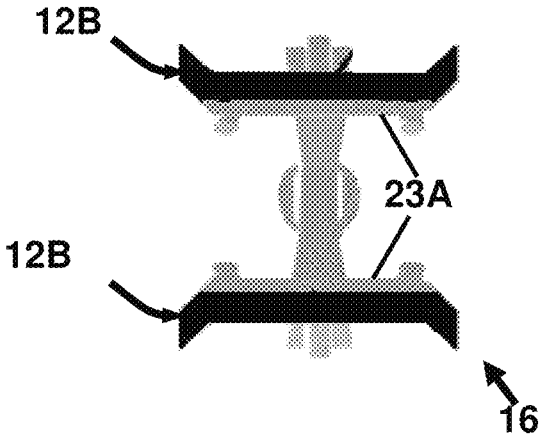

FIG. 2F is a bottom view of the bottom surface of the golf ball push down ball lifter-setter 16 of FIGS. 1 and 2A showing hook-and-loop fastener material 12B secured to the bottoms of feet 23A on the bottom of the legs 24 of golf ball lifter-setter 16 which are complementary to RDFs such as the hook-and-loop fasteners 12A of FIG. 2D. The hook-and-loop fasteners 12B are adapted to fasten to the hook-and-loop fasteners 12A shown in FIG. 2D in order to hold the push down ball lifter-setter 16 and shaft 14 of FIG. 1 in a convenient, upright position for use by a user, i.e. a golfer.

FIG. 3A-FIG. 3I illustrate steps of performing the method of the present invention with a push down, lifter-setter claw 16A. Alternate front and side views respectively are shown of the push down, lifter-setter claw 16A.

Figure 3A:
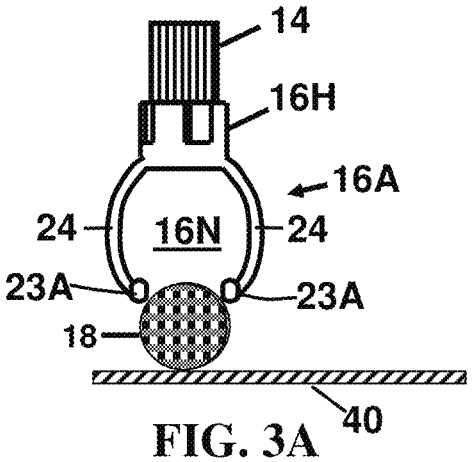
FIG. 3A-FIG. 3I illustrate steps of performing the method of the present invention with a push down, lifter-setter claw. Alternate front and side views respectively are shown of the push down, lifter-setter claw.
Figure 3B:
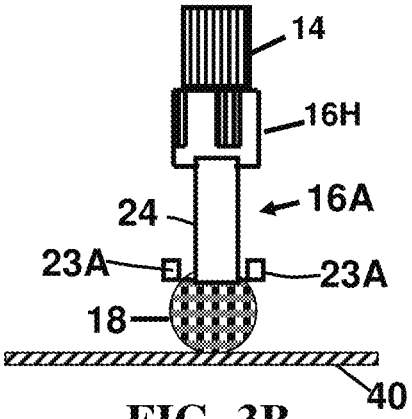

Referring to FIGS. 3A and 3B, the push down, lifter-setter claw 16A is attached to the bottom of a shaft 14. FIG. 3A shows the front view of the first step, which is to prepare to capture a golf ball 18 resting on a support 40 by setting the push down, lifter-setter 16A feet 23A on top of a golf ball 18. FIG. 3B shows the side view.

Figure 3C:
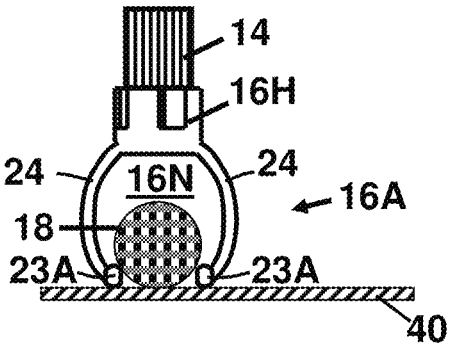
Figure 3D:
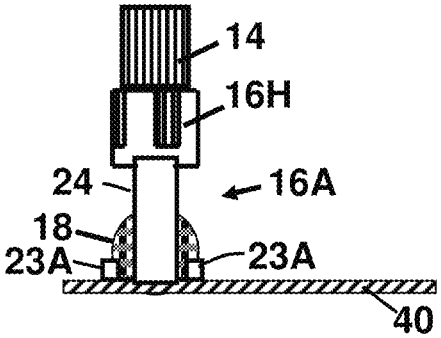
Figure 3E:
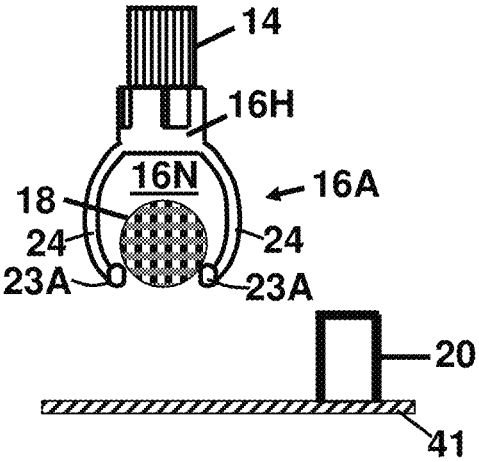
Figure 3F:
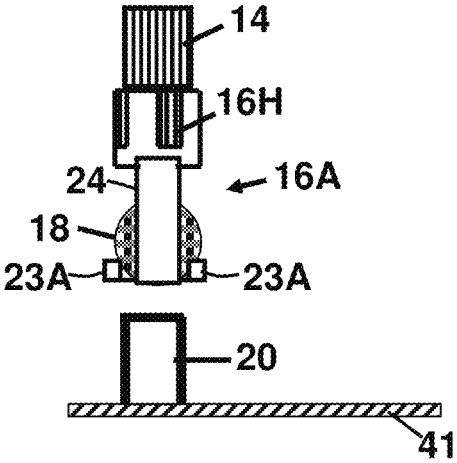

FIG. 3C shows the lifter-setter claw 16A after it has been pushed down to grasp the golf ball 18. The golf ball 18 is shown being held between the two flexible legs 24 and supported by the feet 23A of the push down, lifter-setter claw 16A. FIG. 3D shows the side view.

FIG. 3E shows the lifter-setter claw 16A after the player has lifted the loaded lifter-setter 16A raising the golf ball 18 in its grasp from the support 40 and hovering near a golf tee 10 affixed to a support 41 with which it is misaligned. FIG. 3F shows a side view with the golf tee 20 aligned with the hovering golf ball 18, positioned behind it.

Figure 3G:
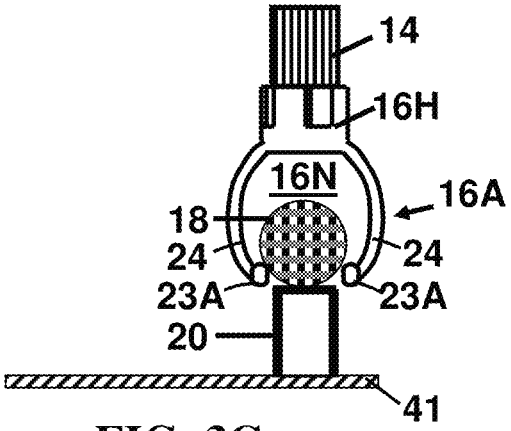
Figure 3H:
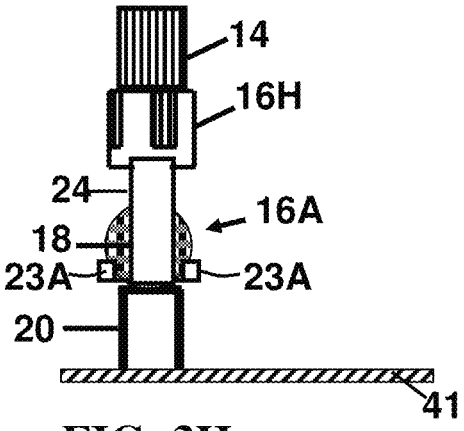

FIG. 3G shows the lifter-setter claw 16A moved by the player with the shaft 14 into a position with the golf ball 18 moved into alignment with the golf tee 20 and lowered onto the top thereof thereby teeing up the golf ball 18. FIG. 3H shows the side view with the golf ball 18 teed up on the golf tee 20.

Figure 3I:
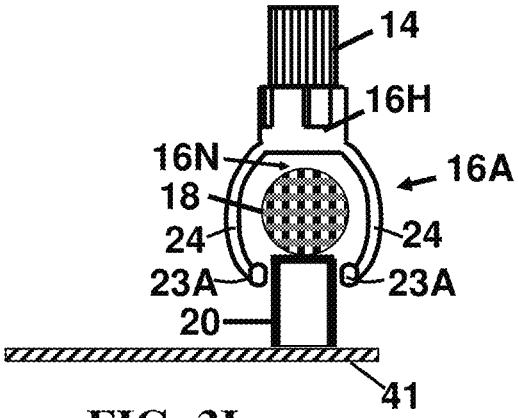
Figure 3J:
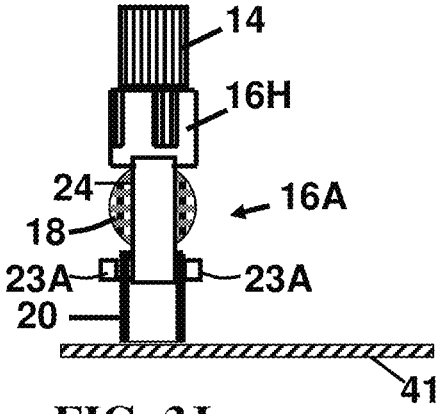

Next as shown by FIGS. 3I and 3J the golfer, who remains in position without bending over, lowers the shaft 14 and the lifter-setter claw 16A below the golf ball 18 which remains sitting on the tee 20. FIG. 3J shows the side view with the golf ball 18 remaining sitting on the tee 20 after lowering of the lifter-setter claw 16A below the golf ball 18.

Figure 3K:
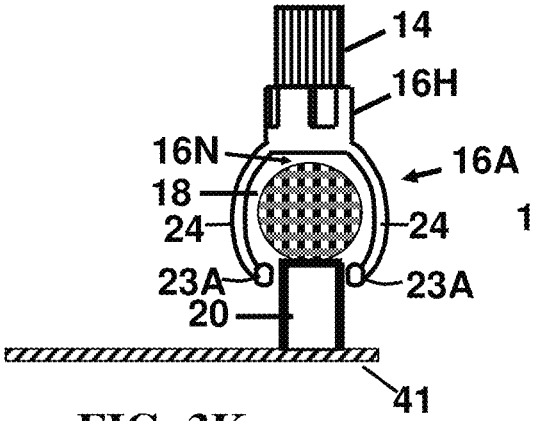
Figure 3L:
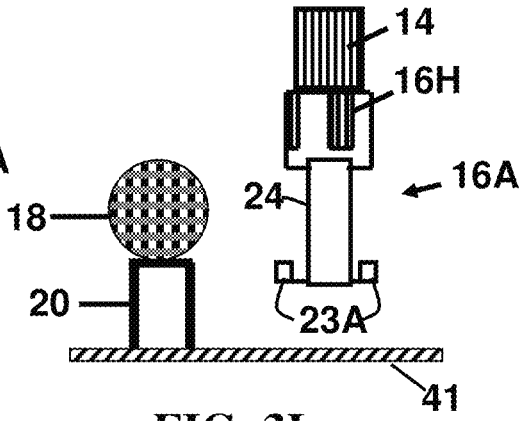

Then, as shown by FIGS. 3K and 3L the golfer slides the shaft 14 laterally removing lifter-setter claw 16A aside from golf tee 20 and the golf ball 18. Then the lifter-setter 16A can be manipulated aside the golf tee 20. Thus at that point, the lifter-setter claw 16A has been moved out of the way having completed the functions required to tee up a golf ball 18 without bending over. As a result a patron who is a golfer at a driving range has been able to perform the functions of picking up and placing a golf ball 10 on the golf tee 20 with no need to bend over to perform either function. FIG. 3L shows the side view with the lifter-setter claw 16A moved aside the golf tee 20.

The lifter-setters of this invention can be composed of plastic formed molding or a plastic extrusion process.

FIGS. 4A-4E show various futures of a stand alone embodiment of the invention comprising a stand alone teeing unit 10S for a modified push down, parkable, lifter-setter tool 16B.

Figure 4A:
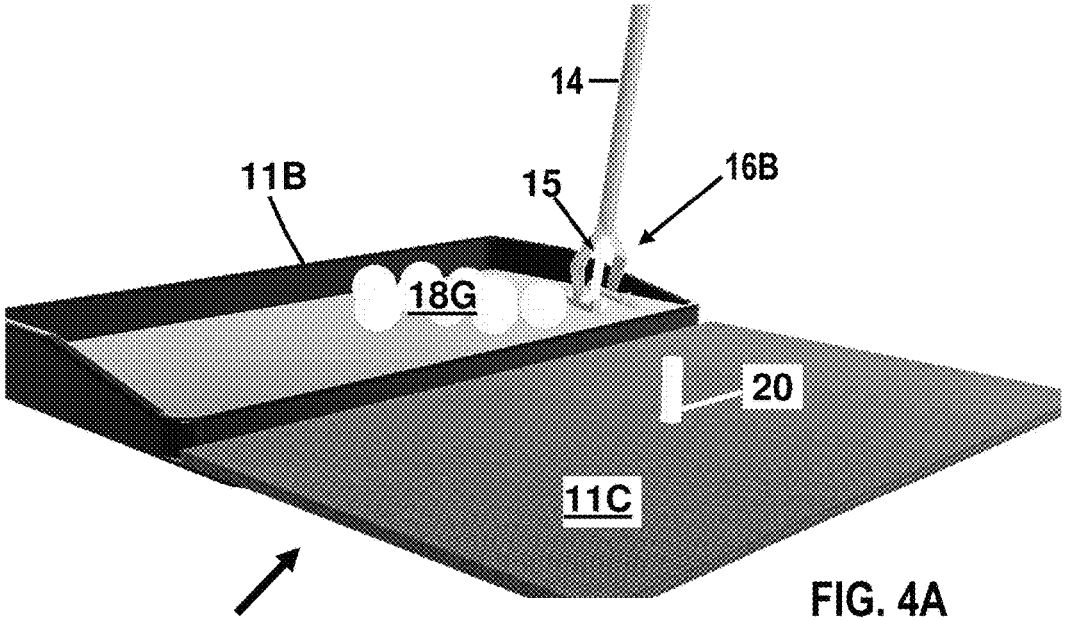
FIGS. 4A-4E show a stand alone embodiment of the invention including a parkable, lifter-setter tool parked on a parking pin plus a golf tee on a support.
Figure 4B:
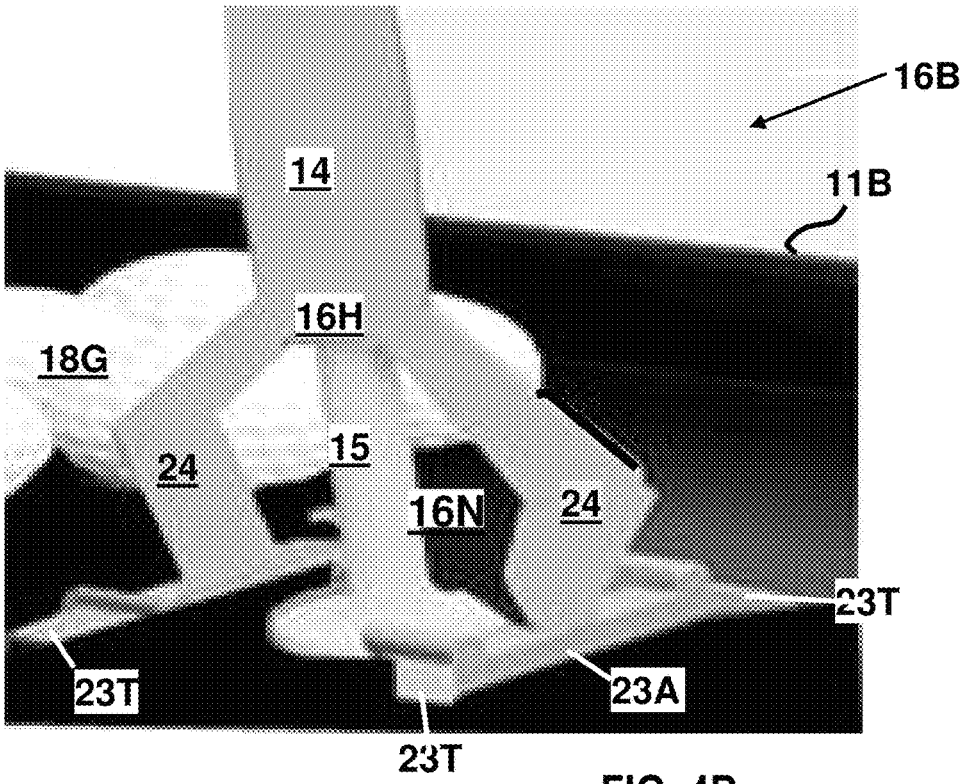
Figure 4C:
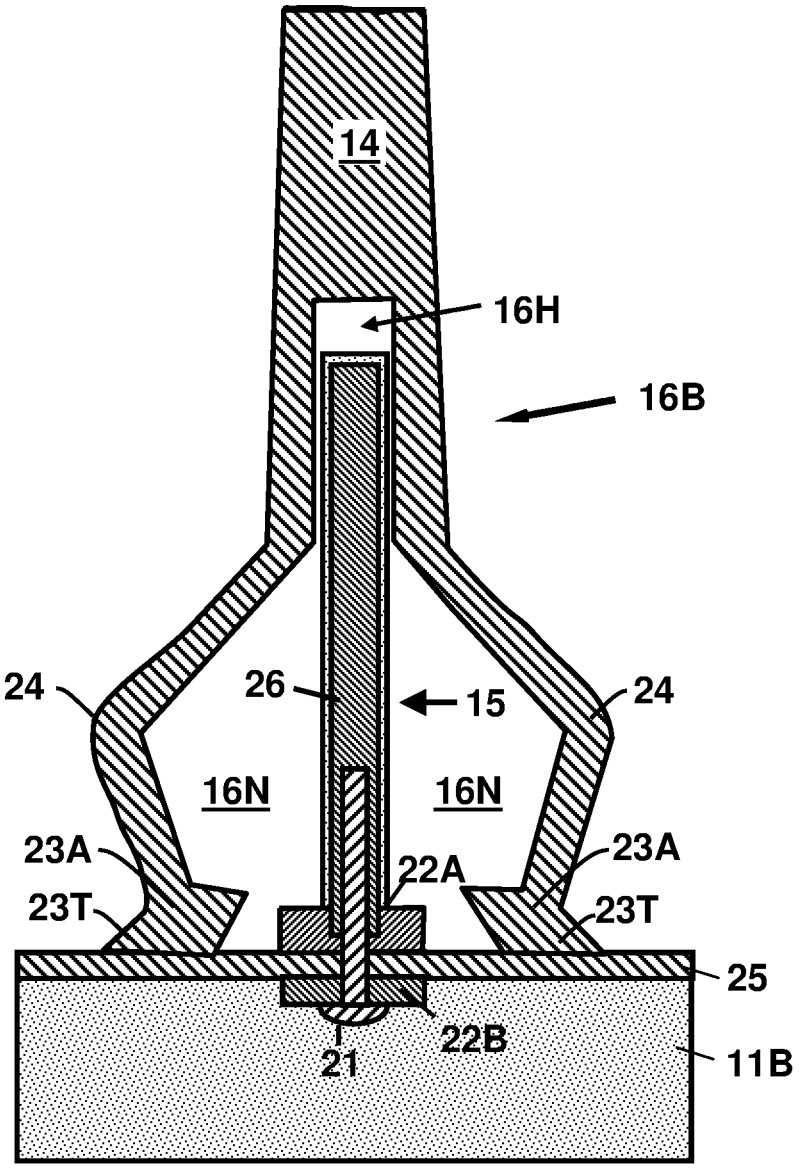
Figure 4D:
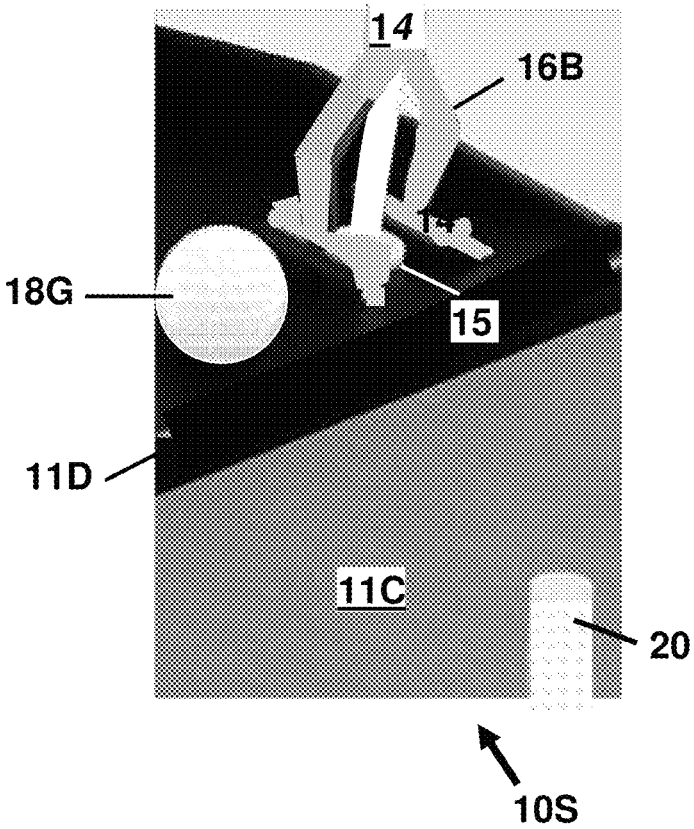
Figure 4E:
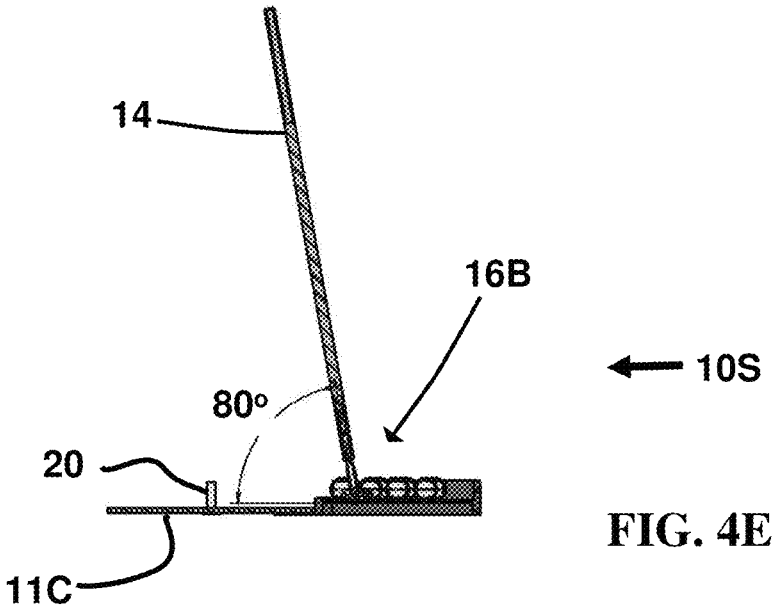

FIG. 4A is a perspective view of the parking pin tray 11B containing a plurality of golf balls 18G showing the stand alone teeing unit 10S including a modified tray 11B and a golf tee support 11C attached to the modified tray 11B. The modified tray 11B houses golf balls18G and an upright parking pin 15 which is shown supporting a modified, parkable, push down, lifter-setter 16B in an upright position. The upright parking pin 15 extends above the surface of the modified tray 11B and the parking pin 15 fastened at its base securely to the modified tray 11B. FIG. 4B shows more details of the modified parkable push down, lifter-setter 16B parked on the parking pin 15. The golf tee support 11C has an upright golf tee 20 fastened thereto. The parkable, lifter-setter tool 16B is shown parked on the parking pin 15 that is inserted into the lower end thereof as described in more detail below with reference to FIG. 4C. The golf tee support 11C which is attached to the tray 11B as a part of the integral stand alone teeing unit 10S is shown in FIGS. 4D and 4E.

FIG. 4B shows an enlarged, perspective view of the modified, parking pin tray 11B containing a plurality of golf balls 18G with the modified, parkable, push down, ball lifter-setter tool 16B parked on the parking pin 15. The modified, push down ball lifter-setter tool 16B is located in a convenient position for a user, i.e. golfer, to grasp it when parked on the parking pin 15 at a golf driving range. The modified, push down ball lifter-setter tool 16B, which is composed of flexible material; is adapted to be raised and lowered with the shaft 14 to grasp a golf ball 18 in its small, cradle like, nest 16N shown in FIGS. 4B and 4C. FIG. 4C is a sectional elevation of the modified, push down, parkable lifter-setter tool 16B shown parked on the parking pin 15 mounted upon the parking pin tray 11B. Lifter-setter tool 16B is formed with a vertical, central hole 16H, (centered between the legs 24), in the bottom end of the shaft 14 (truncated for convenience of illustration) so that the modified, parkable, lifter-setter tool 16B can be parked on the parking pin 15 by insertion thereof into the central hole 16H between lifter-setter operations. The parking pin 15 supports the modified, lifter-setter tool 16B in a position convenient for the user, i.e. golfer, to lift it with the legs 24 on opposite sides of the truncated shaft 14 to perform the method of the present invention. The two legs 24 on opposite sides of the shaft 14, two feet 23B, and several toes 23T, also formed on opposite sides of the shaft 14, form a nest 16N as with the lifter-setter tool 16 of FIG. 2A, described above. Referring to FIG. 4C, the_parking pin 15 includes a polymer coated, metal core 26, which includes a threaded bore therein for securing the parking pin 15 to a metal plate 25 fastened to the top surface of the modified golf ball tray 11B. The parking pin 15 is secured to the metal plate 25 by a cap screw 21 screwed into the threaded bore including upper and lower washers 22A/22B on both upper and lower surfaces of the metal plate 25.

The push down, parkable, lifter-setter tool 16E includes two flexible legs 24 with two feet 23B and toes 23T with a nest 16N for a golf ball as described above with reference to FIG. 2A.

Then, referring again to FIG. 4A, one of the golf balls 18G can be grasped with the, lifter-setter tool 16B and moved onto a golf tee 20 fastened to golf tee support 11C employing the steps of FIGS. 3A-3L in accordance with this invention as described above. For that purpose, the shaft 14, shown in FIG. 4B, attached to a lifter-setter 16B is ready to be used by a golfer to lift and then set down a golf ball 18 onto the golf tee 20. Then the golfer lowers the lifter-setter 16B with shaft 14 which remains sitting on the golf tee 20 to release the golf ball 18 from the grasp of the lifter-setter 16B by lowering it below the golf ball 18 and then sliding the lifter-setter 16B sideways away from the golf tee 20. These steps are completed by a golfer in a few continuous motions a very short interval, without bending down.

FIG. 4C is a sectional elevation of the push down, parkable, lifter-setter tool 16B parked on the parking pin 15. The parking pin 15 includes a polymer coated, metal core 26, and includes a threaded bore securing the parking pin 15 to the metal plate 25 which is fastened to the top surface of the modified golf ball tray 11B. The parking pin 15 is secured to the metal plate 25 by a cap screw 21 and upper and lower washers 22A/22B on both surfaces of the metal plate 25. The push down, parkable, lifter-setter tool 16E includes two flexible legs 24 with two feet 23B and toes 23T with a nest 16N for a golf ball as described above with reference to FIG. 2A.

FIGS. 4D-4E show a stand alone embodiment of the invention including a golf tee 20 on the golf tee support 11C.

FIG. 4D is another perspective view of the parkable, lifter-setter tool 16B fastened to a shaft 14 and resting on a parking pin 15 that is fastened to parking pin tray 11B, (filled with golf balls 18G) and near the golf tee 20 on the golf tee support 11C.

FIG. 4E is a schematic diagram of the parkable, lifter-setter tool 16B the parking pin tray 11B located near a golf tee 20 on the golf tee support 11C and attached to a long shaft 14 that is preferably tilted at an eighty degree obtuse angle from vertical for the convenience of golfers picking up and setting down the lifter-setter tool 16B.

Figure 5A:
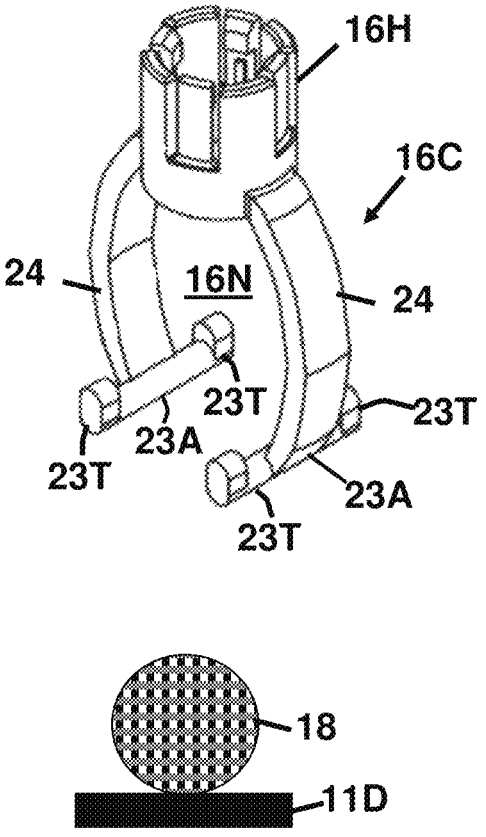
FIGS. 5A and 5B are perspective views of a lifter-setter, claw with a head adapted to be secured on the top of a club handle of an inverted golf club.
Figure 5B:
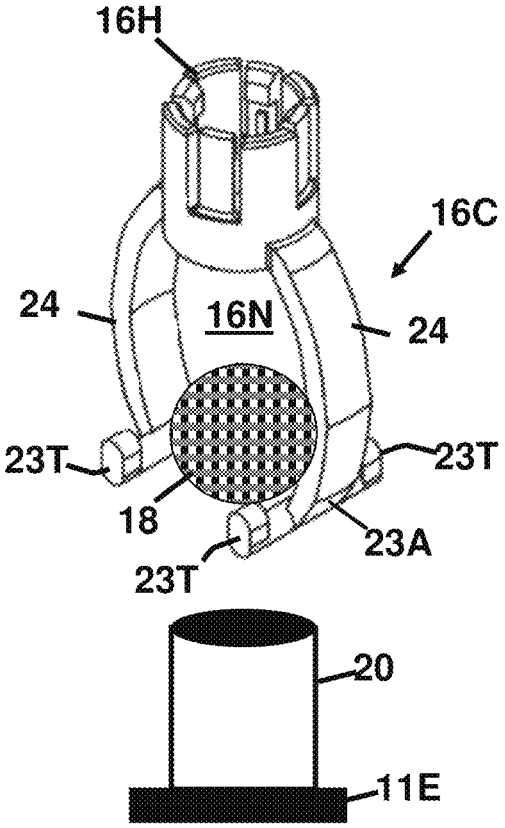

FIGS. 5A and 5B are perspective view a push-down, lifter-setter claw 16C with a head 16H adapted to be secured on the top of a club handle of an inverted golf club. In other words, the claw 16C can be attached the butt end of a typical golf club. The feet 23A, legs 24, toes 23T and nest 16N perform the same functions as described above referring to FIGS. 3A-3L. By virtue of the claw like design configuration of the lifter-setter claw 16C, a player is able to straddle a golf ball 18 on a support 110, the ground or tray and then push down on the claw 16C to engage the legs 24, feet 23A, and toes 23T of the claw 16C with the golf ball 18, which soon springs upwardly as described above, and the golf ball 18 is in the grasp of the lifter-setter claw 16C.

FIG. 5B shows the claw 16C after it has picked up, and captured a golf ball 18 from support 110 hovering above golf tee 20 on a separate support 11E. The golf ball 18 rests in the nest 16N of the lifter-setter claw 16C, as shown in FIG. 5B. The advantage is that a player can then use a golf club or shaft to place the captured golf ball 18 on a golf tee without ever bending down. It is ready for the user to lower the claw 16C to tee up the golf ball 18, as described above, without having to bend down.

After the golf ball 18 is resting on top on the golf tee 20, the user, can lower the claw 16C below the golf ball 18 and the and tee 20 so that by virtue of the open ends of the claw 16C between the toes 23T the claw 16C can be moved clear of contact with the tee 20 and the golf ball 18 by lowering the claw 16C and then sliding it laterally away from the tee 20. Thus, after the golf ball 18 is on the a tee 20 the player can lower the claw 16C, and then slide the claw 16C laterally away from the tee 20 without disturbing the golf ball 18 or the tee 20.

Figure 6A:
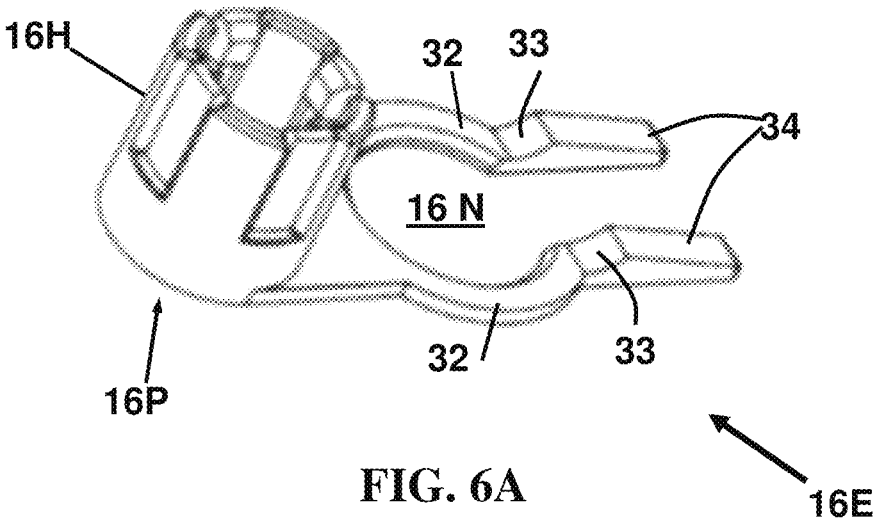
FIGS. 6A-6G are drawings illustrating steps of operation of a shovel up, alternative style golf ball, lifter-setter, which also performs the method of this invention.

FIGS. 6A-6G are drawings illustrating steps of operation of a shovel up, alternative style golf ball, lifter-setter, which also performs the method of this invention FIG. 6A is a perspective view of the shovel up, golf ball, lifter-setter 16E comprising a truncated shaft 14 secured to the top of a head 16H, a pelvis 16P, and parallel, relatively thin, mirror image, curved, pair of legs 32. The two legs 32 are attached to the pelvis 16P with one leg 32 on each side of the head 16H. The legs 32 extend out the ends of the curves followed by upwardly sloping, curbs 33 and then ending with distal, thinning, downwardly sloping, feet 34 on the ends of the legs 32. The two curved, legs 32 extend laterally at a right angle from the pelvis 16P curved outwardly and back to form a cup shaped nest 16N between the curved, parallel legs 32 adapted to hold and support a golf ball 18 nested therein. At the end of the curved, parallel legs 32 there are thickened, upwardly sloping, curbs 33 followed by a thinning wedge shaped, downwardly sloping, pair of feet 34. The downwardly sloping feet 34 have thin ends to permit sliding thereof under a golf ball 18 to retain it behind the curbs 33 on the top surfaces of the curved, pair of legs 32 at the transition between the legs 32 and the sloping feet 34. The curbs 33 are provided to hold a golf ball 18 in the cup shaped nest 16N prior to teeing the golf ball 18 up.

Figure 6B:
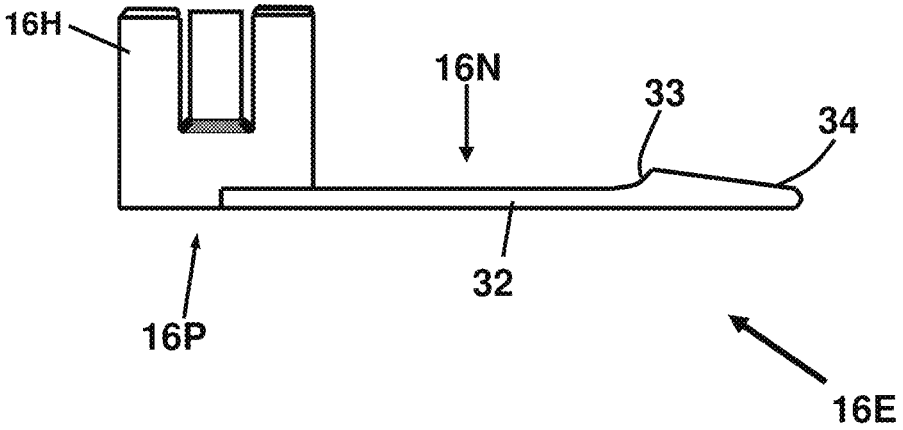

FIG. 6B is a schematic elevational drawing of the shovel up, golf ball, lifter-setter 16E described in FIG. 6A.

Figure 6C:
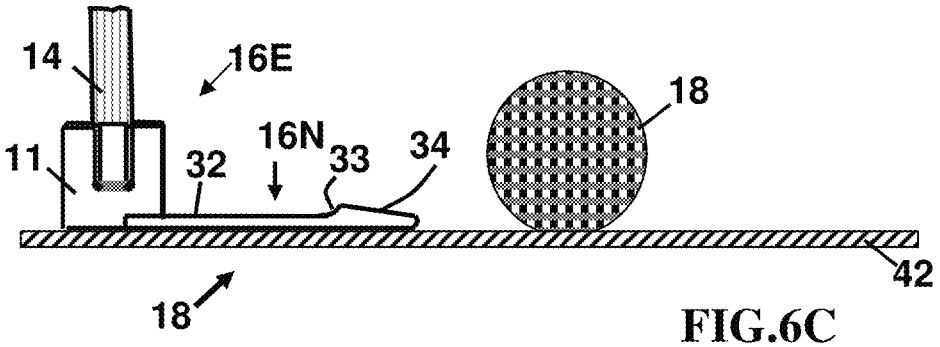

FIG. 6C is a schematic elevational drawing of the shovel up, golf ball, lifter-setter 16E of FIGS. 6A and 6B and a golf ball 18 resting on a flat surface 42. The lifter-setter 16E is spaced to the left of golf ball 18. The lifter-setter 16E is ready to slide under a golf ball 18.

Figure 6D:
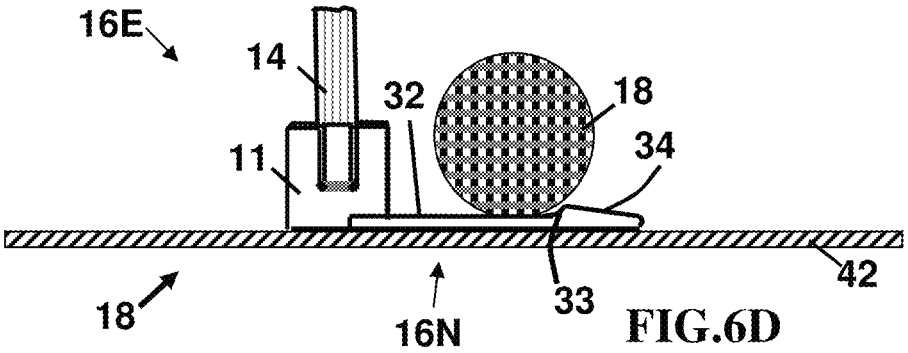

FIG. 6D is a schematic elevational drawing showing the golf ball 18 resting in the nest 16N of the lifter-setter 16E of FIG. 6C on the flat surface 42 after the player has used the shaft 14 to drive the shovel up, golf ball, lifter-setter 16E rapidly to the right to grasp the golf ball 18 on the cup shaped nest 16N, ready to use the lifter-setter 16E to lift the golf ball 18 from the surface 42 to tee it up.

Figure 6E:
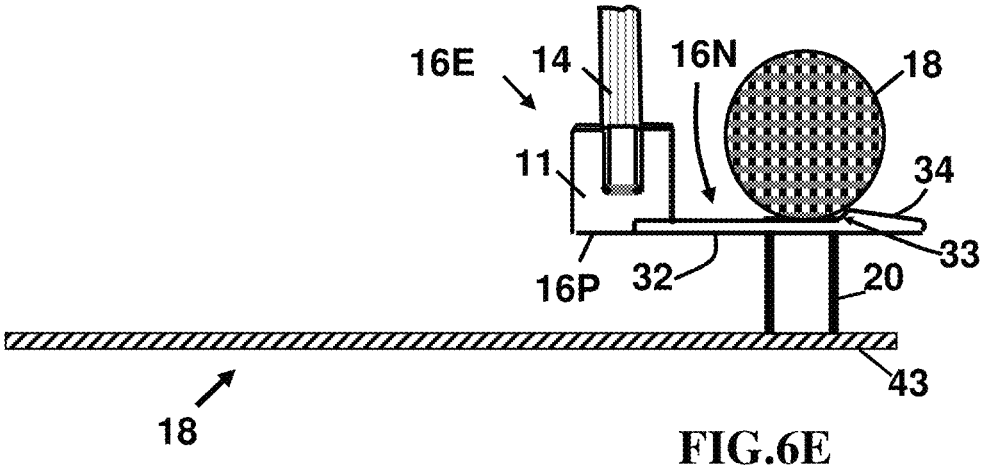

FIG. 6E is a schematic elevational drawing of the next step following that of FIG. 6D after the player has moved the shaft 14 raising the lifter-setter 16E along with the golf ball 18, following which, the player has moved the shaft 14 to set the golf ball 18 in the cup shaped nest 16N on a golf tee 20 on the surface 43 of the golf driving range. Thus the golf ball 18 has been teed up on golf tee 20 on the surface 43 of the golf driving range. The next step is to withdraw the lifter-setter 16E so that the golf ball 18 can be freed from the cup shaped nest 16N of the lifter-setter 16E so that it will be ready to be driven by the player with a golf club as described below with reference to FIGS. 6F and 6G.

Figure 6F:
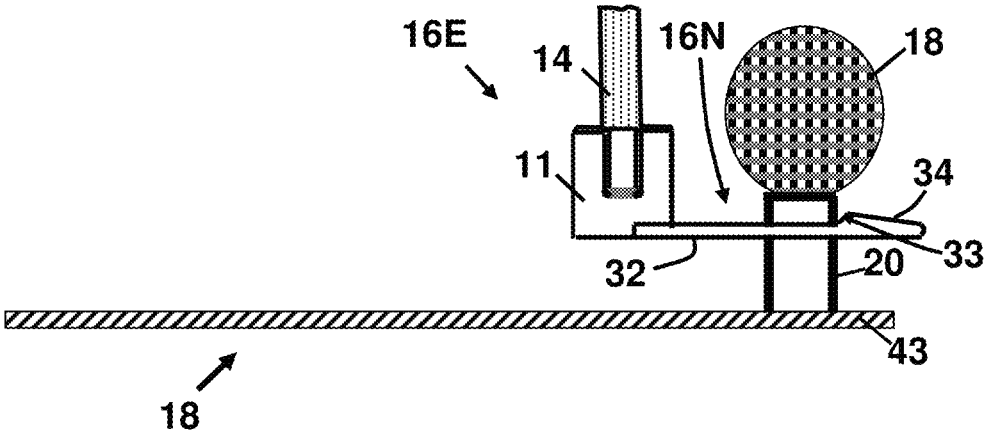

FIG. 6F is a schematic, elevational drawing of the next step following that of FIG. 6E after the player has lowered the shaft 14 with the lifter-setter 16E including the nest 16N, the legs 32, the curbs 33, the feet 34 and the cup shaped nest 16N below the previously grasped golf ball 18 with the lifter-setter 16E remaining just as close to the golf tee 20 regardless of the fact that the golf ball 18 has been released by lowering the cup shaped nest 16N below the golf ball 18.

Figure 6G:
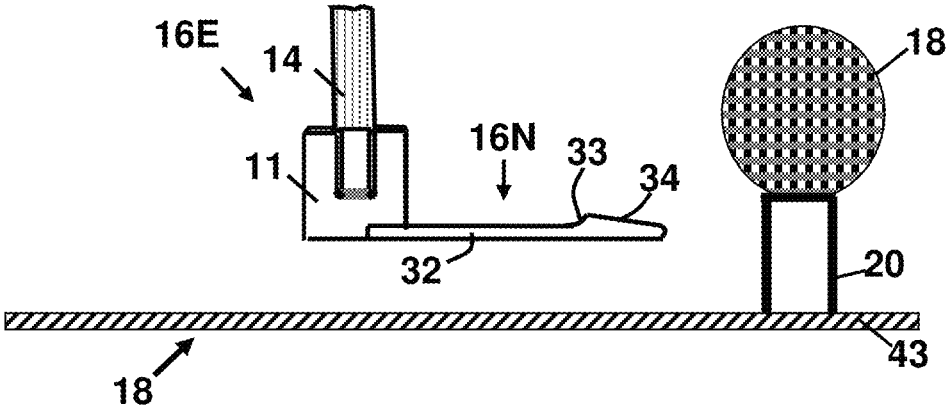

FIG. 6G is a schematic, elevational drawing of the next step following that of FIG. 6F in which the player has use the shaft 14 to move the lifter-setter 16E to the left of the teed up golf ball 18 and the golf tee 20 without disturbing them. Thereafter, the lifter-setter 16E including the cup shaped nest 16N are removed from the location of the teed up golf ball 18 on the golf tee 20 and parked elsewhere.

Figure 7:
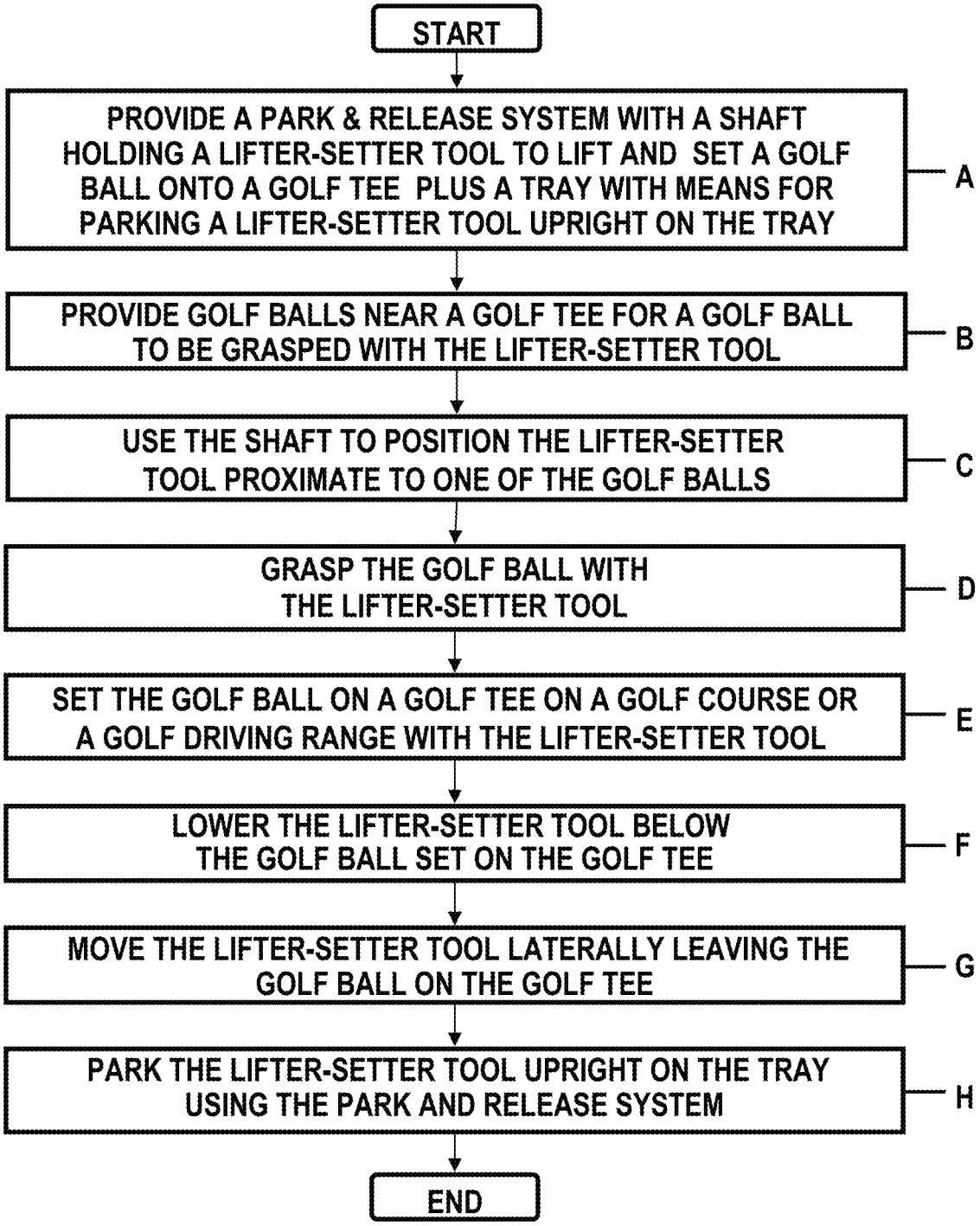
FIG. 7 is a flowchart describing the method of this invention.

FIG. 7 is a flowchart describing the method of this invention. In step A provide a park and release system with a shaft 14 holding a lifter-setter tool 16 to lift and set a golf ball 18 onto a golf tee 20 (especially at a golf driving range) plus a tray 11 with means for parking a lifter-setter tool 16 upright on the tray 11. The park and release system means for parking a lifter-setter tool 16 upright on the tray 11 is selected from Readily Dissociable Fasteners (RDFs) such as hook-and-loop fasteners, touch fasteners, and mushroom head fasteners, inter alia and lifter-setter tools 16 adapted to sit on parking pins 16. In step B, provide golf balls 18G near a golf tee 20 including a golf ball 18 to be grasped with the lifter-setter tool 16. In step C, use the shaft 14 to position the lifter-setter tool 16 proximate to one of the golf balls 18. In step D, grasp the golf ball 18 with the lifter-setter tool 16. In step E, set the golf ball 18 on a golf tee 20 of a golf course or a golf driving range with the lifter-setter tool 16. In step F, lower the lifter-setter tool below the golf ball 18 and set the golf ball 18 on the golf tee 20. In step G, move the lifter-setter tool 16 laterally leaving the golf ball 18 on the golf tee 20. In step H, park the lifter-setter tool 16 upright on the tray 11 using a park and release system.

Figure 8:
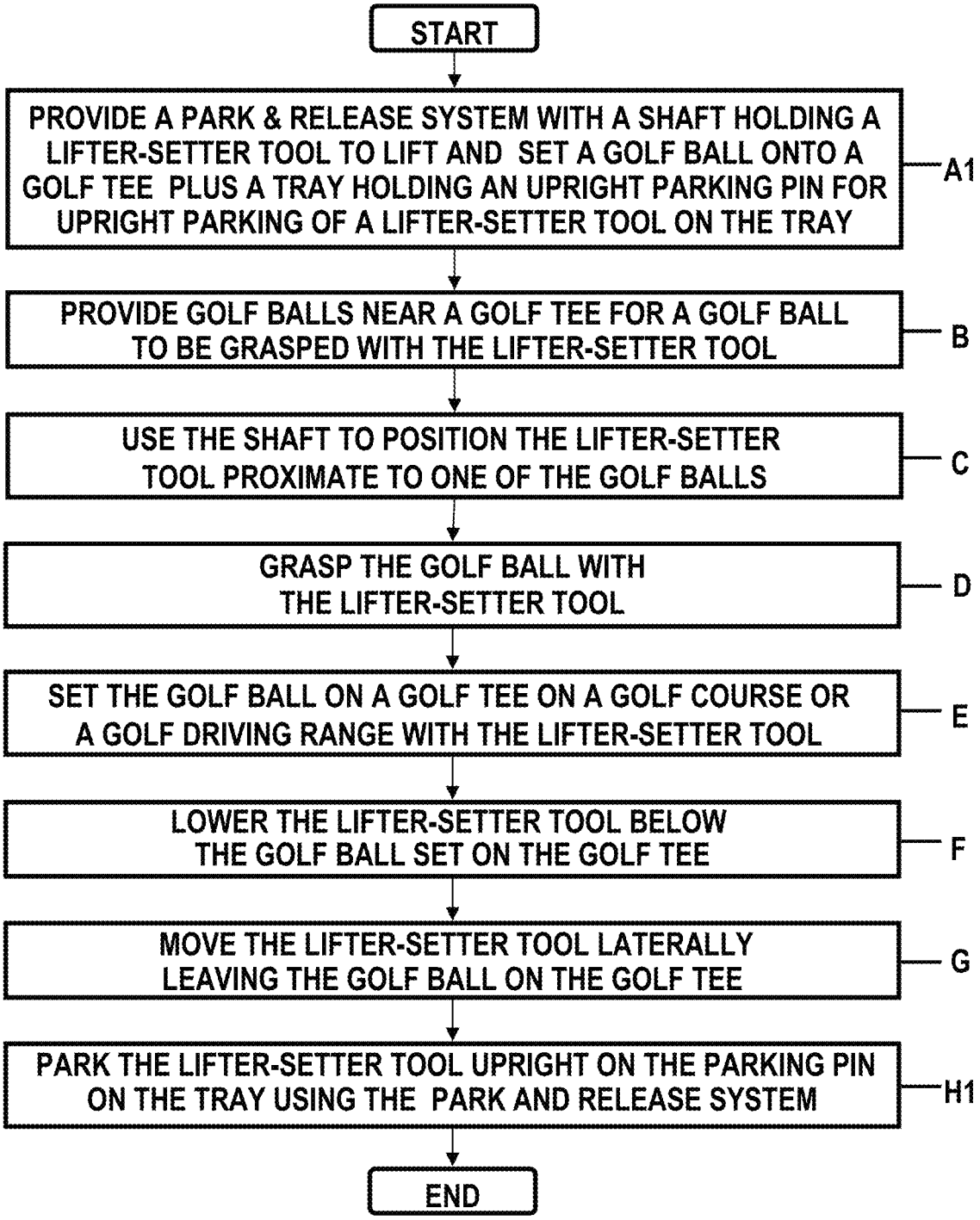
FIG. 8 is a flowchart describing an alternative version of the method of this invention.

FIG. 8 is a flowchart describing an alternative version of the method of this invention. In step A1 provide a park and release system with a shaft 14 holding a lifter-setter tool 16 with a parking pin hole 16H and with the lifter-setter tool 16 being adapted to lift and set a golf ball 18 onto a golf tee 20 (especially at a golf driving range) plus providing a tray 11 holding an upright parking pin 15 insertable into the parking pin hole 16H of the lifter-setter tool 16 for parking of a lifter-setter tool 16 upright on the tray 11. In step B, provide golf balls 18G near a golf tee 20 including a golf ball 18 to be grasped with the lifter-setter tool 16. In step C, use the shaft 14 to position the lifter-setter tool 16 proximate to one of the golf balls 18. In step D, grasp the golf ball 18 with the lifter-setter tool 16. In step E, set the golf ball 18 on a golf tee 20 of a golf course or a golf driving range with the lifter-setter tool 16. In step F, lower the lifter-setter tool below the golf ball 18 and set the golf ball 18 on the golf tee 20. In step G, move the lifter-setter tool 16 laterally leaving the golf ball 18 on the golf tee 20. In step H1, park the lifter-setter tool 16 in an upright position with parking pin 15 inserted into the parking pin hole 16H so that the lifter-setter tool 16 is secured in an upright position on the parking pin 15 on the tray 11, thereby using the lifter-setter tool park and release system.

Figure 9:
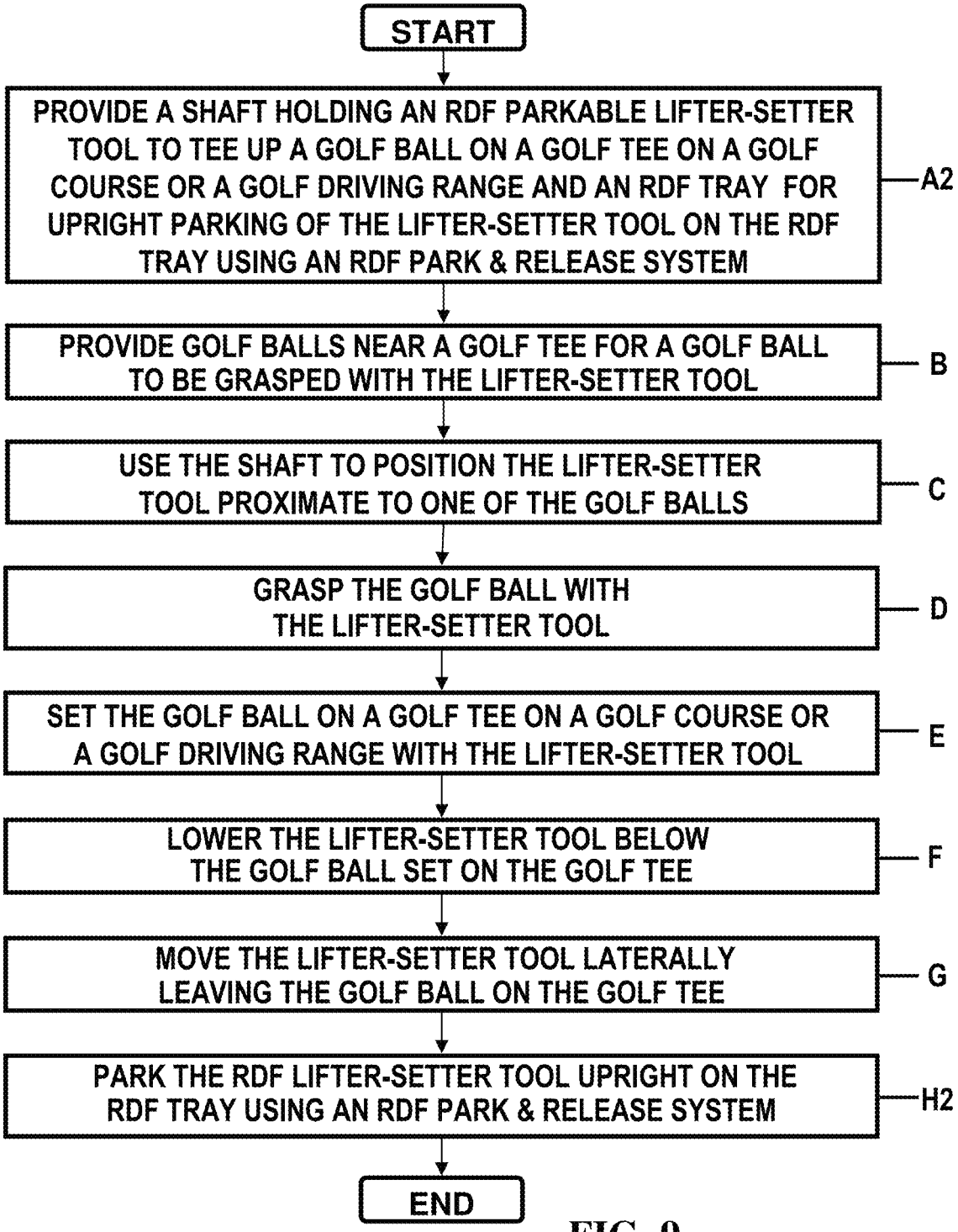
FIG. 9 is a flowchart describing another alternative to the method of this invention.

FIG. 9 is a flowchart describing another alternative to the method of this invention. In step A2 provide a park and release system with a shaft 14 holding an RDF parkable lifter-setter tool 16 to lift and set a golf ball 18 onto a golf tee 20 (especially at a golf driving range) plus an RDF tray 11 for parking a lifter-setter tool for upright parking of a lifter-setter tool 16 upright on the tray 11. In step B, provide golf balls 18G near a golf tee 20 including a golf ball 18 to be grasped with the lifter-setter tool 16. In step C, use the shaft 14 to position the lifter-setter tool 16 proximate to one of the golf balls 18. In step D, grasp the golf ball 18 with the lifter-setter tool 16. In step E, set the golf ball 18 on a golf tee 20 of a golf course or a golf driving range with the lifter-setter tool 16. In step F, lower the lifter-setter tool below the golf ball 18 and set the golf ball 18 on the golf tee 20. In step G, move the lifter-setter tool 16 laterally leaving the golf ball 18 on the golf tee 20. In step H2, park the lifter-setter tool on the tray using the hook and loop lifter-setter tool park and release system.

The foregoing description discloses exemplary embodiments of the invention. Modifications of apparatus and methods disclosed above which within the scope of the invention will be readily apparent to those of ordinary skill in the art. While this invention is described in terms of the above embodiment(s), those skilled in the art will recognize that the invention can be practiced with modifications within the spirit and scope of the appended claims, i.e. changes can be made in form and detail, without departing from the spirit and scope of the invention. Accordingly, while the present invention is disclosed in connection with exemplary embodiments thereof, it should be understood that changes can be made to provide other embodiments which may fall within the spirit and scope of the invention and all such changes come within the purview of the present invention and the invention encompasses the subject matter defined by the following claims.

What is claimed is:

1. A method of lifting and setting a golf ball on a golf tee with a lifter-setter tool followed by parking the tool on a male parking pin by the steps as follows comprising:

a) providing a golf ball lifter-setter tool including a mechanically, mating, upright parking element with a female parking hole in the bottom of a shaft which is attached to a push down, golf ball, lifter-setter tool; with the golfball, lifter-setter tool having a nest attached to the shaft for temporarily holding a golf ball; and providing an upright, golf tee and an upright, complementary mechanically mating male parking pin, both rigidly fastened to the top surface of a golf ball tray; with the male parking pin being secured to a plate with a threaded bore fastened by a cap screw to the surface of the golf ball tray, —and with the male parking pin being adapted to be inserted into the female parking hole to park the lifer setter tool thereon;

b) providing the complementary, mechanically mating upright male parking pin being affixed to a golf ball tray;

c) the user moves the shaft to position the nest of the lifter-setter tool above the top of a golf ball;

d) the user presses down on the shaft causing the lifter-setter tool to hold the golf ball in the nest;

e) the user raises the lifter-setter tool with the golf ball held in the nest;

f) the user moves the lifter-setter tool with the golf ball held in the nest above a golf tee affixed to a golf tee support;

g) the user lowers the lifter-setter tool down to set the golf ball in the nest onto the golf tee;

h) the user lowers the shaft thereby lowering the nest of the lifter-setter tool below the golf ball to release the golf ball set on the golf tee from the nest;

i) the user uses the shaft to slide the nest of the lifter-setter tool laterally away from the golf ball and the golf tee;

j) the user lifts the shaft with the lifter-setter tool; and k) the user parks the female parking hole onto the male parking pin affixed to the golf ball tray by inserting the male parking pin into the female parking hole.

2. The method of claim 1 wherein the means for parking includes the female parking hole in the bottom of the shaft of the lifter-setter tool with the female parking hole being adapted to mount the tool on the male parking pin, with the male parking pin being affixed to the golf ball tray by the cap screw extending through the bottom surface of the golf ball tray with the cap screw being screwed into a hole in the parking pin.

3. The method of claim 1 wherein the user parks the golf ball lifter-setter tool by lowering the shaft carrying the ball lifter-setter tool thereby mounting the female parking hole onto the male parking pin by inserting the male parking pin into the female parking hole in the bottom of the shaft of the golf ball lifter-setter tool.

4. The method of claim 2 wherein the user parks the ball lifter-setter tool on the male parking pin by lowering the shaft carrying the ball lifter-setter tool to mount the female parking hole in the bottom of the shaft of the golf ball lifter-setter tool onto the male parking pin.

5. The method of claim 3 wherein the male parking pin and the golf tee are affixed to the golf ball tray which holds at least one golf ball.

6. Apparatus in accordance with claim 2 wherein the bottom end of the lifter-setter tool includes the nest for a golf ball, with two flexible opposing legs spaced apart by a width narrower than a golf ball extending down on opposite sides of the bottom end with each opposing leg ending with a foot with a toe and the opposing feet and toes forming a nest therebetween;

the flexible legs being adapted to widen by bending, and to hold a golf ball in the nest; and the downwardly facing hole in the lifter-setter tool for parking the shaft and the lifter-setter tool upright on the parking pin.

7. Apparatus in accordance with claim 6 wherein the golf ball tray is adapted for holding a golf ball and has both the upright golf tee and the male parking pin secured thereto.

8. Apparatus for manual lifting and setting a golf ball on a golf tee comprising a park and release system including:

a shaft having a head with the bottom end of the shaft including a parkable, golf ball, lifter-setter tool and with a mechanically mating, female parking hole in the bottom of the shaft;

an upright, golf tee and an upright, complementary, mechanically mating, male parking pin both rigidly secured to a golf ball parking tray provided for holding at least one golf ball, the lifter-setter tool including a nest attached to the bottom end of the shaft for temporarily holding a golf ball;

and the mechanically mating female parking hole at the bottom end of the lifter-setter tool being parkable on the male parking pin;

wherein the upright male parking pin is fastened to the golf ball parking tray by a screw, and wherein the male parking pin including a threaded bore in the bottom of the parking pin, is secured to a plate fastened to the parking tray with the threaded bore in the bottom of the male parking pin fastened to the golf ball parking tray by the screw extending through the plate into the threaded bore in the bottom of the parking pin.

9. Apparatus for manual lifting and setting a golf ball on a golf tee comprising a park and release system including:

a shaft having a head and the bottom end of the shaft including a parkable, golf ball, lifter-setter tool and a mechanically mating female parking element;

an upright, golf tee and an upright, complementary mechanically mating male parking pin, both rigidly screwed to a golf ball tray;

the lifter-setter tool comprising the shaft connected to a nest for temporarily holding a golf ball; and a mechanically mating, parking female element at the bottom end of the shaft of the lifter-setter tool being parkable on the male parking pin;

wherein the male parking pin includes a polymer coated, metal core, having a threaded bore end for securing the male parking pin to a plate fastened to the surface of the golf ball tray by a cap screw fastened to the threaded bore end.

* * * * *